US009560921B2

(12) United States Patent
Resch

(10) Patent No.: US 9,560,921 B2
(45) Date of Patent: Feb. 7, 2017

(54) COOLING UNIT ARRANGEMENT

(71) Applicant: Reinhold Resch, St. Peter (AT)

(72) Inventor: Reinhold Resch, St. Peter (AT)

(73) Assignee: AHT Cooling Systems GmbH, Rottenmann (AT)

( * ) Notice: Subject to any disclaimer, the term of this patent is extended or adjusted under 35 U.S.C. 154(b) by 0 days.

(21) Appl. No.: 14/423,385

(22) PCT Filed: Aug. 6, 2013

(86) PCT No.: PCT/EP2013/066454
§ 371 (c)(1),
(2) Date: Feb. 23, 2015

(87) PCT Pub. No.: WO2014/029611
PCT Pub. Date: Feb. 27, 2014

(65) Prior Publication Data

US 2015/0208828 A1 Jul. 30, 2015

(30) Foreign Application Priority Data

Aug. 22, 2012 (DE) ..... 10 2012 107 711

(51) Int. Cl.
*A47F 3/04* (2006.01)

(52) U.S. Cl.
CPC ..... *A47F 3/0443* (2013.01); *A47F 3/0447* (2013.01)

(58) Field of Classification Search
CPC ..... A47F 3/0443; A47F 3/0447; A47F 3/04; A47F 3/06; A47F 3/0448; A47F 3/0452; A47F 2003/046
USPC ..... 62/255
See application file for complete search history.

(56) References Cited

U.S. PATENT DOCUMENTS 4,034,572 A * 7/1977 Morris ..... A47F 3/0447 454/193
5,440,894 A 8/1995 Schaeffer et al.
5,743,098 A * 4/1998 Behr ..... A47F 3/0408 62/199
5,924,297 A * 7/1999 Wolff ..... A47F 3/0456 62/152

(Continued)

FOREIGN PATENT DOCUMENTS

CA 676 020 A 12/1963
CA 821 795 A 9/1969

(Continued)

OTHER PUBLICATIONS

Co-pending U.S. Appl. No. 14/423,043, Resch, Reinhold, "Cooling Device," filed Feb. 20, 2015.

*Primary Examiner* — Mohammad M Ali
(74) *Attorney, Agent, or Firm* — Pauley Erickson & Kottis

(57) ABSTRACT

A cooling unit arrangement including at least two mutually arranged shelf modules, with a base group, a rear wall group and an upper group with respective covering parts and forming a cooling chamber, and a cooling device. The shelf modules have identical modular parts with frame profiles and which support the base group, the rear wall group and the upper group and at least the rear wall group of each shelf module is equipped with components of the cooling device. Said shelf arrangement is provided with a common evaporator arranged in the rear wall group and extending along several or all shelf modules.

21 Claims, 22 Drawing Sheets

(56) References Cited

U.S. PATENT DOCUMENTS

| | | | | |
|---|---|---|---|---|
| 6,745,588 | B2 * | 6/2004 | Kahler | A47F 3/0486 211/169.1 |
| 7,318,321 | B2 * | 1/2008 | Grassmuck | A47F 3/0447 312/116 |
| 2002/0062654 | A1 * | 5/2002 | Navarro | A47F 3/001 62/255 |
| 2002/0162346 | A1 * | 11/2002 | Chiang | A47F 3/0447 62/246 |
| 2003/0084675 | A1 * | 5/2003 | Thurman | A47F 3/0404 62/246 |
| 2003/0172670 | A1 * | 9/2003 | Vormedal | A47F 3/0447 62/407 |
| 2005/0257548 | A1 | 11/2005 | Grassmuck et al. | |
| 2011/0302945 | A1 | 12/2011 | Howington et al. | |
| 2015/0230627 | A1 | 8/2015 | Resch | |

FOREIGN PATENT DOCUMENTS

| | | | |
|---|---|---|---|
| CN | 1 935 060 | A | 3/2007 |
| DE | 297 17 444 | U1 | 1/1998 |
| DE | 102 19 101 | A1 | 11/2003 |
| DE | 20 2006 007 152 | U1 | 8/2006 |
| DE | 10 2006 020 717 | B3 | 7/2007 |
| DE | 20 2010 008 333 | U1 | 12/2010 |
| EP | 0 696 893 | A | 2/1996 |
| EP | 1 359 381 | A2 | 11/2003 |
| EP | 1 743 552 | A1 | 1/2007 |
| EP | 2 190 321 | A1 | 6/2010 |
| FR | 2 907 202 | A1 | 4/2008 |
| JP | S48-45596 | U | 6/1973 |
| JP | S51-125372 | U | 10/1976 |
| JP | S52-028053 | A | 3/1977 |
| JP | S58-20885 | U | 2/1983 |
| JP | S59-76973 | U | 5/1984 |
| JP | S61-3378 | | 1/1986 |
| JP | S62-105077 | | 5/1987 |
| JP | H01-158092 | U | 10/1989 |
| JP | H04-110365 | U | 9/1992 |
| JP | H06 265 255 | A | 9/1994 |
| JP | 2001-221561 | A | 8/2001 |
| TW | 382439 | U | 2/2000 |
| WO | WO 94/26154 | A1 | 11/1994 |
| WO | WO 2005/074749 | A1 | 8/2005 |
| WO | WO 2005/075910 | A1 | 8/2005 |
| WO | WO 2012/025240 | A2 | 7/2007 |
| WO | WO 2009/015674 | A1 | 2/2009 |
| WO | WO 2011/074993 | A1 | 6/2011 |
| WO | WO 2011/074994 | A1 | 6/2011 |
| WO | WO 2013/002849 | A1 | 1/2013 |

* cited by examiner

COOLING UNIT ARRANGEMENT

BACKGROUND OF THE INVENTION

Field of the Invention

This invention relates to a cooling unit system composed of a cooling device and at least two shelving modules that can be aligned in a row and in identical fashion, have a base group, a rear wall group, and an upper group with respective casing parts and form a cooling chamber. The shelving modules have identical module frames with frame profiles, which support the base group, the rear wall group, and the upper group, and at least the rear wall group of each shelving module is equipped with components of the cooling device.

Discussion of Related Art

German Patent Reference DE 20 2010 008 333 U1 discloses a cooling unit in which it is also possible to place several of these cooling units next to one another. The cooling unit has a flat cooling element, which is embodied as particularly flat and which is placed in a rear wall group of the cooling unit and can also optionally be integrated into a base group or an upper assembly. The cooling unit also has a system composed of vertical adjusting rails that can be inserted into one another and horizontal adjusting rails attached to them at the top and bottom, protruding toward the front. The vertical adjusting rails are positioned between a rear wall and air-guiding walls situated close to the cooling chamber and are spaced apart by the same distance as these walls. The distance of the air-guiding walls from the rear wall is determined by the width of the heat exchanger or by fans, which produce an air flow along the heat exchanger. If a correspondingly high cooling power is required, then the heat exchanger is connected to a central refrigeration unit. The connection procedure must be performed by a specialized company. When there are a large number of such cooling units, this entails a corresponding installation expense.

U.S. Pat. No. 5,440,894 discloses a cooling unit system with a cooling device that has different components such as evaporators, condensers, compressors, and the like in order to provide the necessary cooling chambers required in a supermarket sector. The entire cooling unit system with the cooling device includes various shelves and cabinet units accommodating components of the cooling device. The entire refrigeration system entails a significant installation expense.

Another cooling unit system is disclosed in PCT Patent Reference WO 2012/025240 A2. In this known design, a plurality of modularly embodied cooling units are combined in a system with a plurality of cooling units. Each cooling unit has a cooling device specific to the cooling unit, with an evaporator, a condenser, and a compressor. A cooling device specific to the cooling unit can also be associated with at least two cooling units. The cooling units can be connected in parallel or in series via a secondary circuit to a central heat exchanger.

The condenser and a control unit are positioned in the upper region of the cooling unit, while the compressor is positioned in its lower region. In individual cases on site, circumstances frequently arise that require complex installation work and that impede the installation.

PCT Patent Reference WO 2005/075910 A1 proposes another cooling unit system with modular cooling units that have an overall length of 1250 mm, for example. The cooling unit modules each have their own cooling unit with evaporator(s), fan(s), expansion valve(s), and control(s). The cooling unit of a cooling unit module can be embodied as a so-called plug-in cooling unit or can be connected via corresponding pipework to a central refrigeration system. By embodying the cooling unit system inside the individual cooling unit modules, it is possible to achieve different temperatures or temperature groups or classes. This design is intended, for example, to eliminate the disadvantage of elongated heat exchangers and evaporators that have a length of greater than 3000 mm in cooling unit systems composed of a plurality of refrigeration unit modules, as is known in the design according to German Patent Reference DE 102 19 101 A1. Even shelving modules with such predetermined designs can cause problems during installation on site due to different circumstances that make it difficult to achieve an optimum adaptation to the conditions while also achieving an efficient energy use.

SUMMARY OF THE INVENTION

One object of this invention is to provide a cooling unit system of the type mentioned above but with which it is possible to adapt to different on-site conditions with a simple installation.

This object and others are attained with the features of this invention as described in this specification and the claims. In this case, the module frames with the frame profiles form side frames of the shelving modules and the base group, the rear wall group, and the upper group are mounted to the side frames with respective casing parts. The cooling device includes at least one compressor, an evaporator, a condenser, connecting means including connecting lines, a fan, and a control device with a control unit, where the cooling unit system is provided with a shared evaporator provided in the rear wall group and extending along several or all of the shelving modules, and the rear wall group, the base group, and/or the upper group of each shelving module is/are embodied for detachable installation of other components of the cooling device.

These measures achieve a stable basic structure of the shelving modules with simple installation options for the components of the cooling device and assembly of the shelving modules to produce the cooling unit system comprised of or comprising one or more, such as two or three shelving modules, so-called biaxial or triaxial system. For example, the entire cooling unit system can be preassembled and then positioned in the intended location inside the building. Where provided, the connecting means, including connecting lines integrated into the shelving modules or the cooling unit system and provided in the building, can also be used to produce a simple connection to a central heat exchanger of a refrigeration system. From a mechanical standpoint, the entire evaporator can be embodied of one piece or of individual evaporator units, which are fluidically connected to one another for the circulation of the refrigerant, preferably forming a compact unit.

In one advantageous embodiment of the cooling unit system, only some of the shelving modules, in particular only one of the shelving modules, are provided with a compressor and/or a control unit. These measures provide for a simple design with a simultaneously simple installation in the building. In particular, only one compressor, one control unit, and one condenser are used for a plurality of shelving modules and optionally, the connection to a central heat exchanger of a refrigeration system via a supply line and a return line is also correspondingly simple.

In one embodiment of this invention, which is advantageous for heat removal and heat is removed by the cooling device being connected to a central heat exchanger via connecting lines.

In one embodiment of this invention that is advantageous for a good function, with an efficient energy use and a simple design, the rear wall group between a thermally insulating outer casing and an inner cover that adjoins the cooling chamber at the back and is provided with ventilation openings, and a vertical intermediate space is provided. The vertical intermediate spaces of adjacent shelving modules complement one another to form a combined intermediate space extending continuously across the entire width of the cooling unit system, which space is closed in a sealed fashion at the lateral ends, and the evaporator extends in the combined intermediate space.

One advantageous design also has the evaporator fastened to adjacent vertical profiles and/or to the front side of a flat intermediate partition.

Other advantageous embodiments for the design, the assembly, and the installation are achieved if the receiving device for each shelving module or for only one of them is equipped in the lower region of the rear wall group with a receiving chamber for a compressor and is equipped in the rear wall group or in or on the upper group with a receiving part for the control unit and/or a condenser. In addition to the only one compressor and the only one control unit, the cooling unit system can also be provided with other components of the cooling device.

Another advantageous measure is if the compressor and the control unit are situated in the same shelving module.

In this case, additional advantages for the design and installation are achieved if in addition, only one condenser is provided in the cooling unit system for the part of the group of shelving modules or for all of them and is situated in the same shelving module as the compressor and the control unit.

One stable design with advantages for the assembly and installation is achieved if the side frames each has a rear vertical profile, a lower horizontal profile protruding forward from it at the bottom, and an upper horizontal profile protruding forward from it at the top, a support profile is installed between the upper and lower horizontal profile, spaced apart from the vertical profile toward the front, and the inner cover is attached to the front side or between the support profiles of the two side frames and the thermally insulating outer casing is mounted to the front side, the rear side, or the between the vertical profiles. In this case, the placement of the outer casing onto the front side yields advantages for the thermal insulation and the assembly.

The design, assembly, and function also benefit from the fact that the evaporator extending across the width of several cooling units is positioned between the vertical profiles and the support profiles. The evaporator can, for example, be easily installed through the installation and removal of the support profiles.

Other advantages for the function are achieved if between the inner cover and the outer casing of each shelving module, at least one fan, in particular a radial fan, is provided, which produces a cold air flow through the evaporator.

For the air flow routing, a particularly advantageous embodiment is achieved if one or more fans situated laterally next to one another is/are situated above the evaporator. This yields a uniformly distributed air flow routing through the gap between the vertically extending fins of the evaporator without back pressure, of the kind that can occur when fans are mounted below, and without the risk of electrical malfunctions or damage due to dripping and moisture.

Other advantages for the design, the assembly, and the function are achieved if the base group, on its upper side oriented toward the cooling chamber, is provided with a floor cover and, spaced apart from and below this, with a deflector plate in order to form a lower horizontal intermediate space, the upper group, on its lower side oriented toward the cooling chamber, is provided with a lower cover and, spaced apart from and above this, with an upper cover and/or an intermediate cover in order to form an upper horizontal intermediate space, and the lower and upper horizontal intermediate spaces are fluidically connected to the vertical intermediate space, which contains the evaporator and is situated between the inner cover and the outer casing, for a circulating cold air flow, with the cold air flow being completed via the front side of the shelving modules or the cooling unit system.

In connection with the cooling function of the cooling unit system, other advantages are achieved if in the base group on the underside of the deflector plate, an outer, lower flow conduit is formed by a floor plate situated below it, and in the upper group between the upper cover and the intermediate cover, an outer, upper flow conduit is formed. In the rear wall group between the front side of the outer casing and the intermediate partition, an outer, vertical flow conduit is formed, and the outer, lower flow conduit and the outer, upper flow conduit are fluidically connected to the outer, vertical flow conduit to form a circulating warm air flow, with the warm air conduit being completed via the front side of the shelving modules or the cooling unit system.

BRIEF DESCRIPTION OF THE DRAWINGS

This invention is explained in greater detail in view of exemplary embodiments with reference to the drawings, wherein.

DETAILED DESCRIPTION OF THE INVENTION

Figure 1:
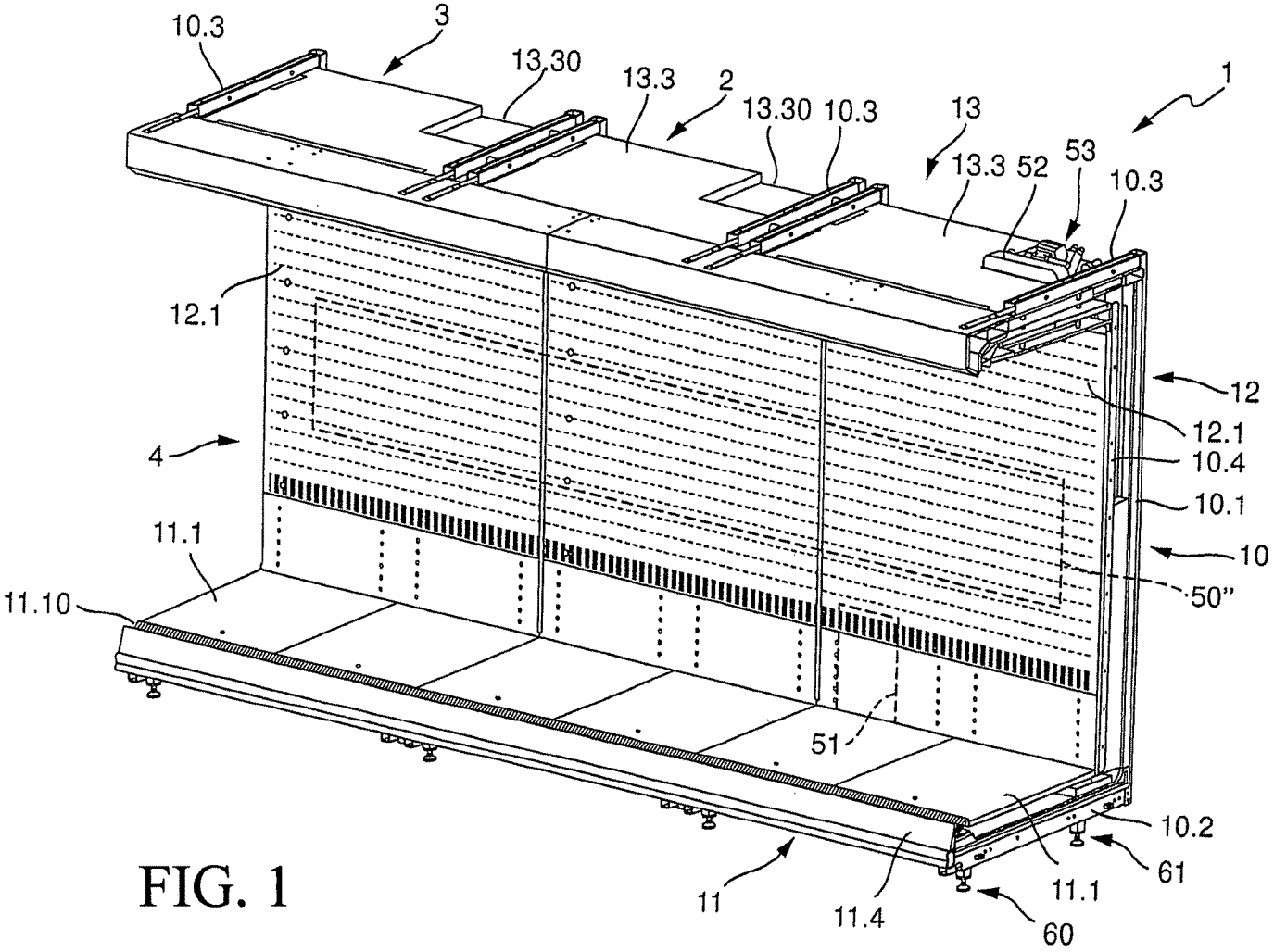
FIG. 1 shows three shelving modules aligned to form a cooling unit system, in the not yet fully assembled state, in a perspective view from the front and to the side.

FIG. 1 shows a unit composed of or comprising three shelving modules 1, 2, 3 combined into a cooling unit system. The cooling unit system encloses a frontally accessible cooling chamber 4 at the back, from above and below, and at least when in use, also from the side, for which purpose the two corresponding side walls are mounted on both sides of the system. The front side can be open and freely accessible or for special applications, can be provided with door elements. When in use, shelves are mounted in the cooling chamber 4, onto which the chilled goods, such as meats, dairy products, or the like, are placed in a sales room. A single shelving module 1, 2, 3 can be used as a cooling unit. Side walls can be mounted on both sides and the front side can be open or can be closed by at least one door element.

Figure 2:
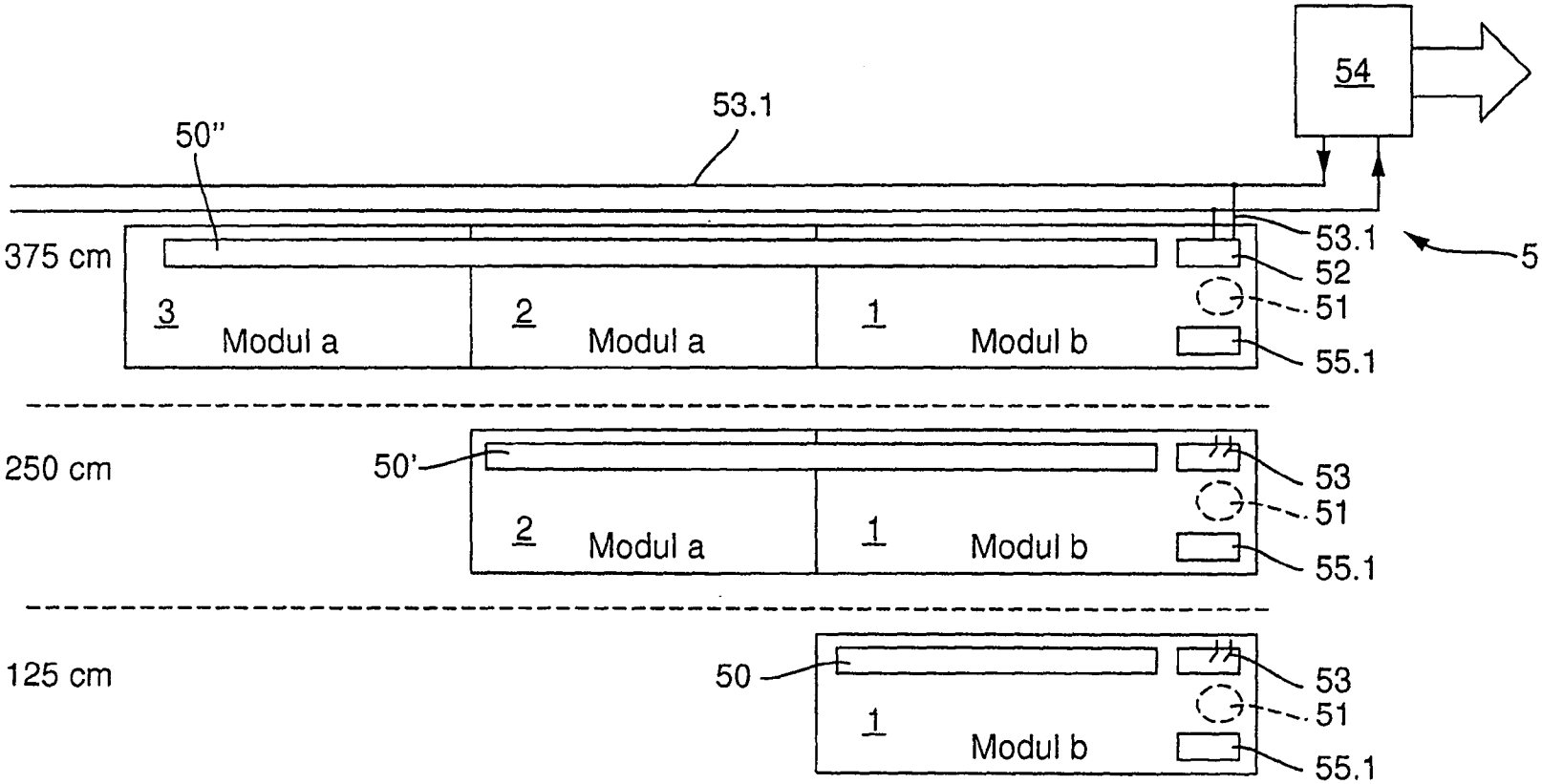
FIG. 2 is a schematic view of three cooling unit systems including one shelving module, two shelving modules, and three shelving modules, respectively, with schematically depicted components of a cooling device with a connection to a central heat exchanger.
Figure 3:
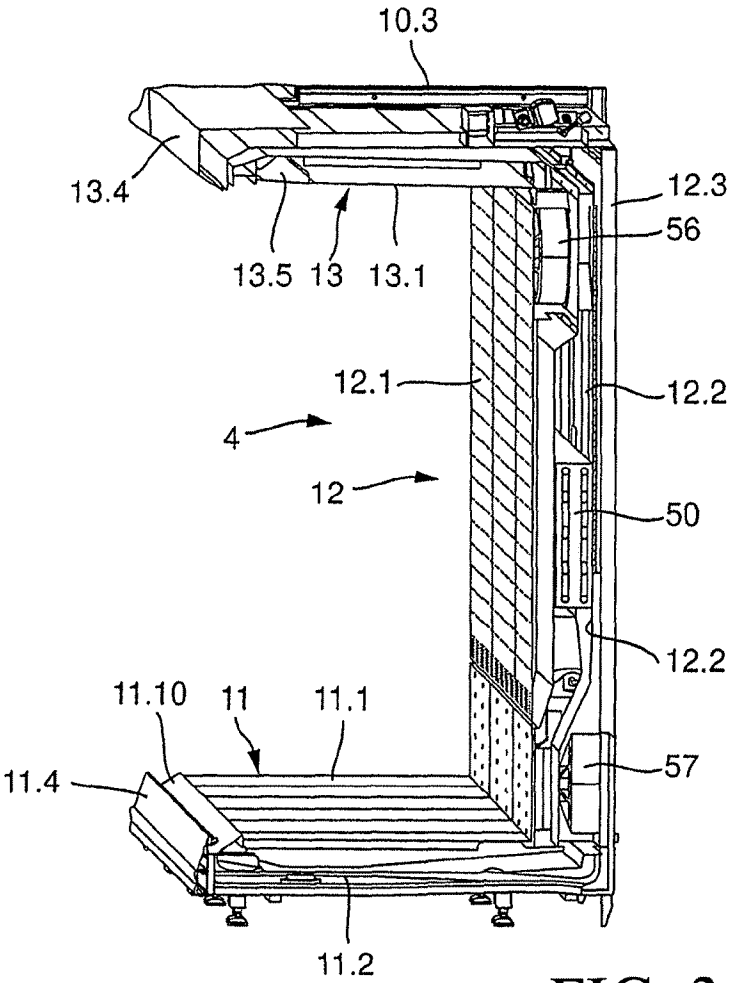
FIG. 3 shows a perspective view of a shelving module obliquely from the front and to the side in a depiction in which it is open at the side.

To keep the cooling chamber 4 cold, components of a cooling device 5 are integrated into the cooling unit system (see FIG. 2), in particular an evaporator 50, 50', 50", a compressor 51, a condenser 52, an expansion valve device, connectors 53 including connecting lines 53.1, and a control unit 55.1 of a control system 55 (see FIG. 8), as well as fans 56, 57 for producing or assisting required air flows (see FIG. 3). The condenser 52 can be connected by corresponding connecting lines 53.1 via a secondary circuit to a heat exchanger 54, such as located in another space. If necessary, it is also possible, for example, for a larger cooling unit system to include a plurality of such components of the cooling device 5.

In one version of the exemplary embodiment shown, the condenser 52 with corresponding connectors 53 is situated or positioned in or on an upper group 13 in an upper cooling component recess 13.30 situated there in the region of an upper cover 13.3 so that it is easily accessible from above or behind, while the compressor Si is preferably situated in the lower region of a rear wall group 12, behind an inner cover 12.1 that delimits the cooling chamber 4 at the back, in a receiving space (not shown in detail) of a receiving device. In the middle region of the rear wall group 12, the evaporator 50, 50', 50" is likewise situated behind the inner cover 12.1 and is mounted with the receiving device. As clear from FIG. 1, the evaporator 50" extends continuously across all three shelving modules 1, 2, 3, while the compressor 51 and condenser 52 for all three shelving modules 1, 2, 3 of the cooling unit system are jointly situated in only one shelving module 1, in the exemplary embodiment according to FIG. 1 in the one on the right, and are connected to the evaporator 50" via corresponding connecting lines with the interconnection of relevant intermediate elements of the cooling device 5 such as expansion valves or restrictors.

Aside from the upper group 13 and rear wall group 12 mentioned above, each shelving module 1, 2, 3 also has a base group 11. With a floor cover 11.1 situated on top, it delimits the bottom of the cooling chamber 4 and at its front, has a covering grating 11.10, which is provided with air passage holes, in particular air passage slots, and a front cover 11.4 with a protective or decorative molding in the front edge region.

Essential components of each shelving module 1, 2, 3 are the side frames 10 situated on each side, which have a C-shaped form when viewed from the side, with a vertical profile 10.1 along the back side, a lower horizontal profile 10.2 connected to and extending forward from the bottom of the vertical profile, and an upper horizontal profile 10.3 connected to and extending forward from the upper end section of the vertical profile 10.1. In the depiction shown, the lower horizontal profile 10.2 extends farther forward than the upper horizontal profile 10.3. Further testing, however, has shown that an upper profile 10.3 that is exactly as long as or longer than the lower horizontal profile 10.2 can be advantageous, for example, to support a front part with a roller curtain and lighting system in a stable fashion, without flexing. A support profile 10.4 is installed in front of the vertical profile 10.1, spaced apart from it toward the front, between the lower and upper horizontal profile 10.2, 10.3. The lower horizontal profile 10.2 is supported on height-adjustable feet 60, 61. The two side frames 10 of each shelving module 1, 2, 3 support the base group 11 by their lower horizontal profiles 10.2, support the rear wall group 12 by their vertical profiles 10.1 and support profiles 10.4, and support the upper group 13 by their upper horizontal profiles 10.3 and produce a stable structure with simple assembly steps. They also make it possible to align a plurality of shelving modules 1, 2, 3 next to one another in a stable fashion or design to form the cooling unit system, it thus being possible to transport the cooling unit system as a stable unit by a hoisting device or vehicle.

As shown in FIG. 2, an advantageous exemplary embodiment of a cooling unit system comprises only one shelving module 1 with all of the components of a cooling device except for the possibly provided central heat exchanger 54, with relevant connecting lines 53.1 leading back and forth (module of design type b), while the other shelving modules of a cooling unit system are only provided with an evaporator 50, 50', 50", with the evaporator 50', 50" advantageously but not necessarily being embodied in the form of a continuous unit (modules of design type a). The evaporator in modules of design type a is connected via corresponding connectors 53 including connecting lines 53.1 and possibly electrical cabling for a signal transmission (sensors, control) and electrical energy supply to the remaining relevant components of the cooling device in the shelving module 1 of design type b. All of the shelving modules 1, 2, 3, however, are prepared in the same way for accommodating all of the required components of the cooling device 5 and also with pre-installed sections of the connecting lines 53.1 and connectors for a fast, easy connection between the cooling components of the shelving modules and possibly with the central heat exchanger 54 so that with little assembly effort, modules of one design type can be converted into a module of the other design type or possibly even of yet another design type with different or additional components of the cooling device. It is also possible, for example in a cooling unit system with a large number of shelving modules, for there to be more than only one shelving module of design type b or of a design type with additional components of the cooling device.

An evaporator 50', 50" extending across a plurality of shelving modules 1, 2, 3 can also be subsequently inserted with relative ease between the relevant vertical profiles 10.1 and support profiles 10.4 that are spaced apart from them and fastened to the vertical profiles and/or to an intermediate partition, in particular an intermediate wall 12.2. The subsequent installation takes place, for example, by inserting the heat exchanger, in particular the evaporator 50, 50', 50", from a side parallel to the plane of the rear wall or from the front, after the removal of relevant support profiles 10.4, which are then reinstalled. As described in greater detail below, the particular assembly method of the support profiles 10.4 permits a simple installation and removal.

As evident from FIG. 2, with the design shown, only one shelving module 1 needs to be connected to the central heat exchanger 54 with the prepared connectors 53, which include quick couplings and controllable valves, for example, while the other shelving modules 2, 3 need only be simply connected to one another via the integrated connector 53. In this case, the central heat exchanger 54 is generally connected via a secondary circuit to the condenser 52 of the relevant shelving module 1 (design type b). A different refrigerant is used in the secondary circuit than in the cooling unit system. For example, a compact plate- or tube heat exchanger can be used for the condenser 52. In the central heat exchanger 54, incoming heat can be removed for another use of the thermal energy, as indicated by the arrow at the top right.

Figure 4:
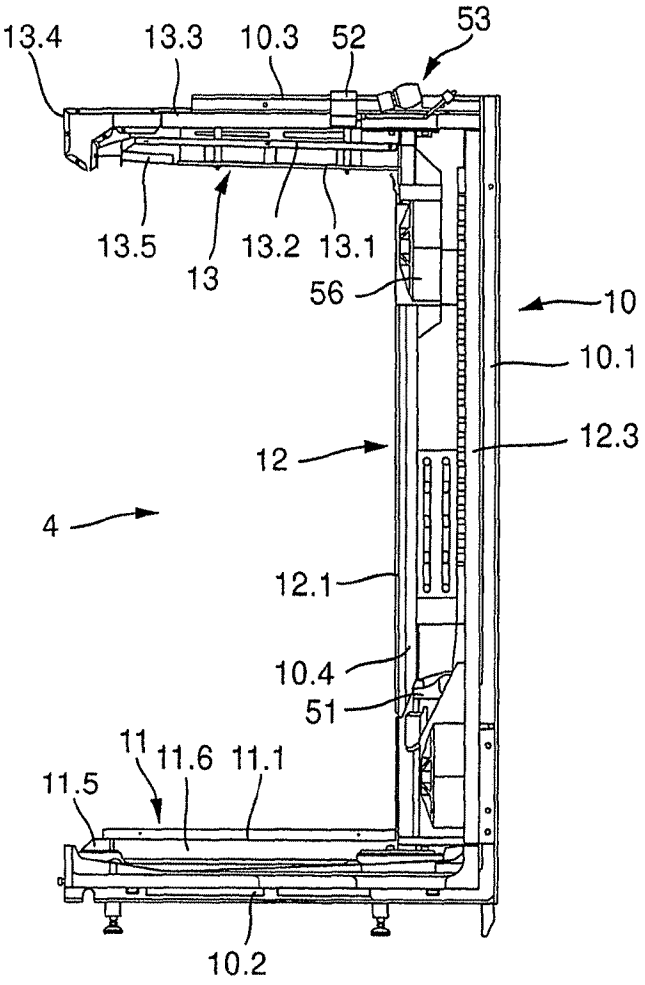
FIG. 4 shows an open side view of a shelving module.
Figure 10:
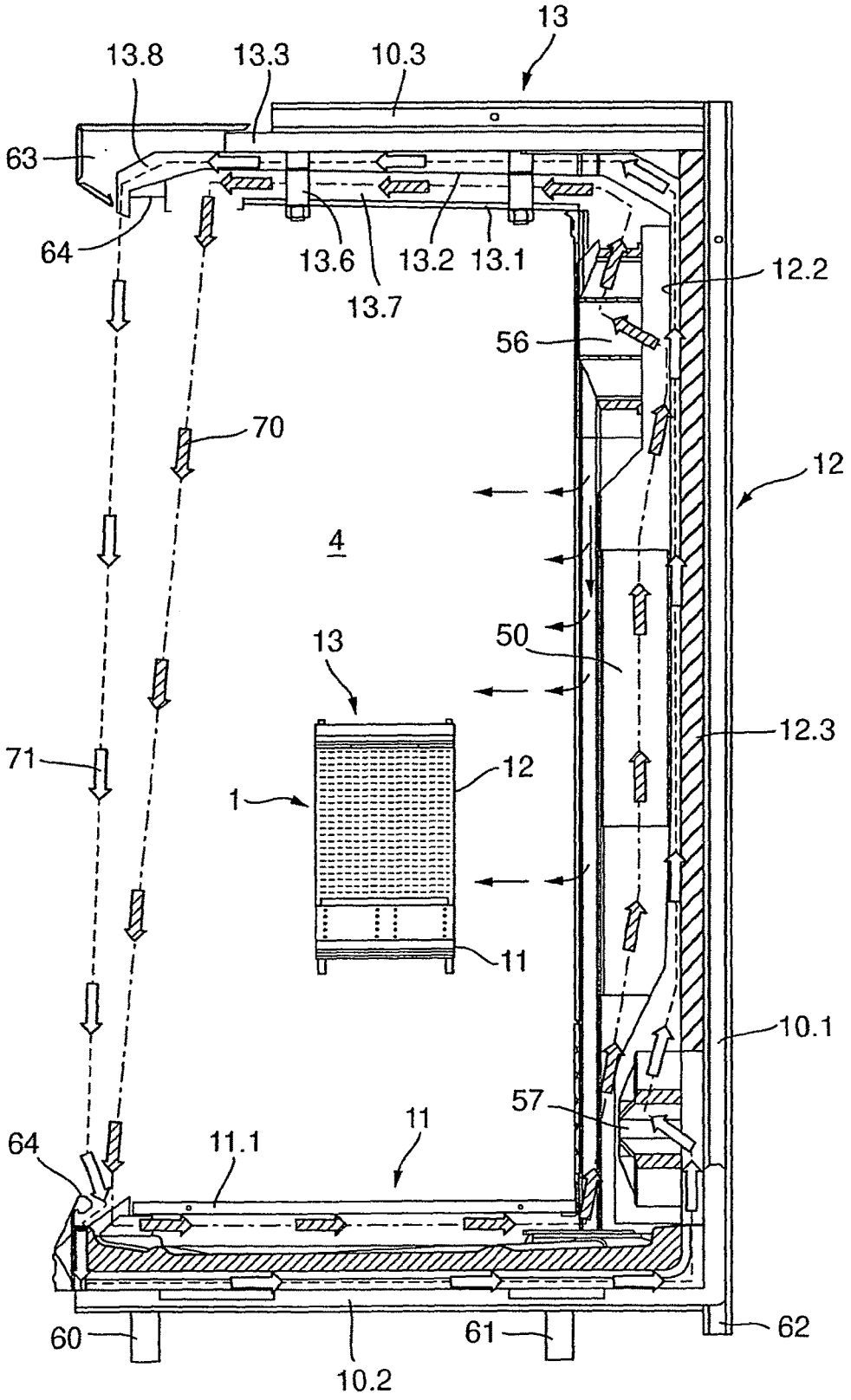
FIG. 10 shows a schematic view of a shelving module in a cross-section viewed from the side.

As shown in FIGS. 3 and 4, the base group 11, the rear wall group 12, and the upper group 13 are embodied of multiple layers with intermediate spaces embodied therein for the air flow routing. The air flow routing is produced or assisted by fans 56, 57, which are embodied in the form of radial fans or diagonal fans and of which, in the exemplary embodiment shown, one is situated in the lower region of the rear wall group 12 and one is situated in its upper region or alternatively two are situated in the upper region of the rear wall group 12. The upper fan or fans 56 in this case each produces the air flow through the evaporator 50, 50', 50" from bottom to top, as indicated in FIG. 10. In this case, a part of the cooling air flow produced by the evaporator 50, 50', 50" conveyed farther downward on the back side of the inner cover 12.1 and flows through the ventilation slots provided in the inner cover 12.1 into the cooling chamber 4 in order to keep the latter at the required refrigeration temperature. In order to achieve an optimum cooling, this cooling air flow that is conveyed into the cooling chamber 4 can be fanned out and suitably adapted, for example by reducing the flow resistance toward the bottom. Another part of the cooling air flow is conveyed via the upper fan(s) 56 through the vertical inner intermediate space 12.4 of the rear wall group 12 into an upward intermediate space 13.7 connected thereto in the upper group 13, along the top of a lower cover 13.1 that delimits the cooling chamber 4 at the top, to a front top section 13.4, where at the underside of the latter, it emerges from a slit-like outlet opening 13.50 with an outlet grating 13.5 and forms a cold air curtain 70 on the front side (see FIG. 10). In the front region of the base group 11, the air flow of the cold air curtain 70 then travels through an inlet opening 11.11 which is provided there, is covered by a covering grating 11.10, and extends along the front side, and back into the intermediate space 11.6 below the floor cover 11.1 in order to then once again flow through the inner vertical intermediate space 12.4 of the rear wall group 12 fluidically connected to it in the circuit through the evaporator and the upper fan 56. In order to ensure a good transmission of the cooling power toward the cooling chamber 4, the floor cover 11.1, the inner cover 12.1, and the lower cover 13.1 of the upper group 13 are composed of or comprise thin-walled plates, in particular of metal or plastic, which are also easy to handle and clean. The plates of the floor cover 11.1 are advantageously segmented in the width direction and extend from the inlet opening 11.11 in the frontal region of the base group 11 to the lower region of the inner cover 12.1 of the rear wall group 12. The plates of the inner cover 12.1 of the rear wall group 12 are advantageously segmented in the vertical direction and extend across the entire width between the two side frames 10 of a shelving module 1, 2, 3. A plurality of plates situated one on top of the other vertically can be inserted or removed in an easily maneuverable way in order to uncover, clean, install, or remove relevant components of the cooling device 5.

Figure 5:
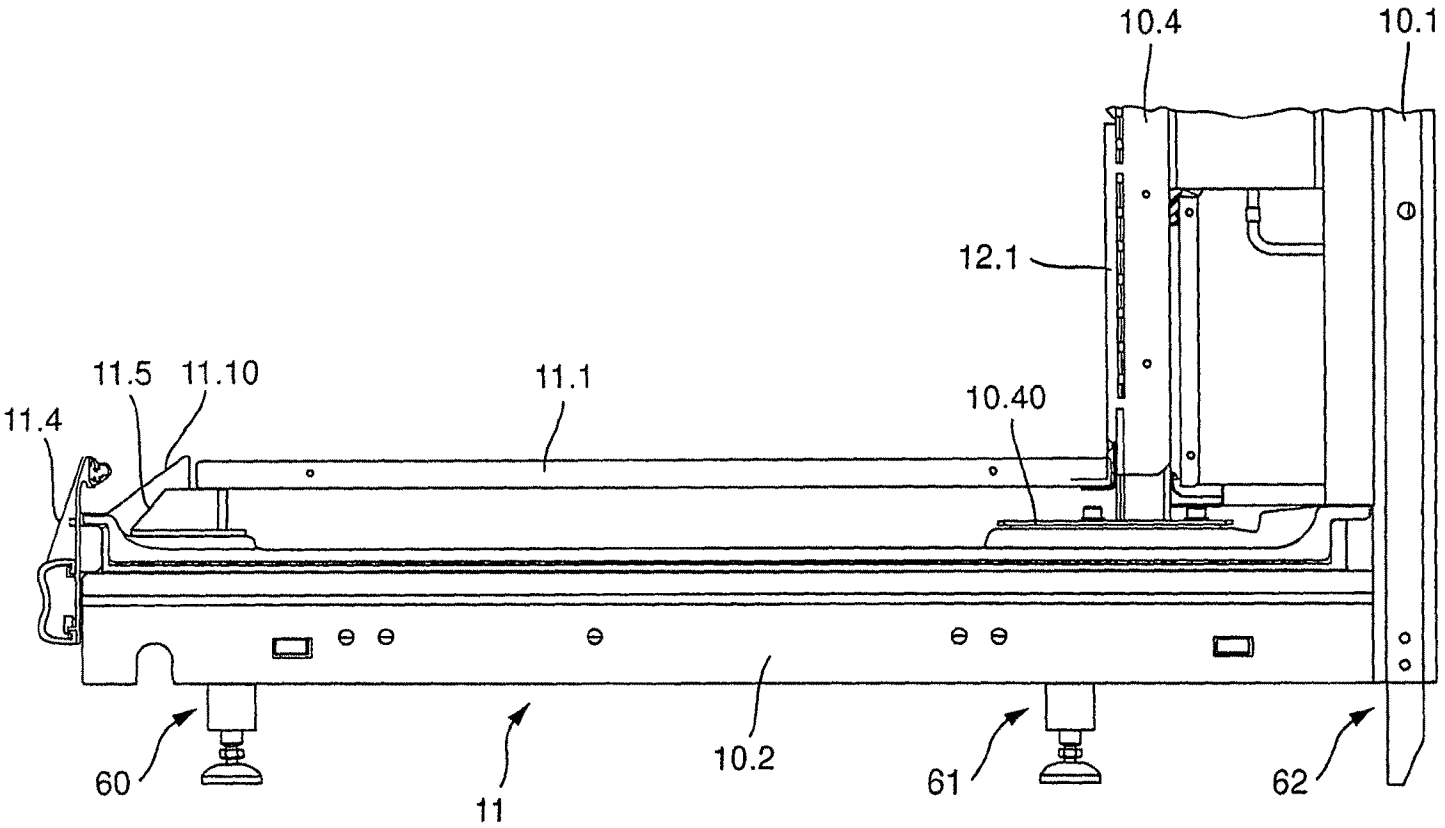
FIG. 5 shows an open side view of a lower section of a shelving module.
Figure 6:
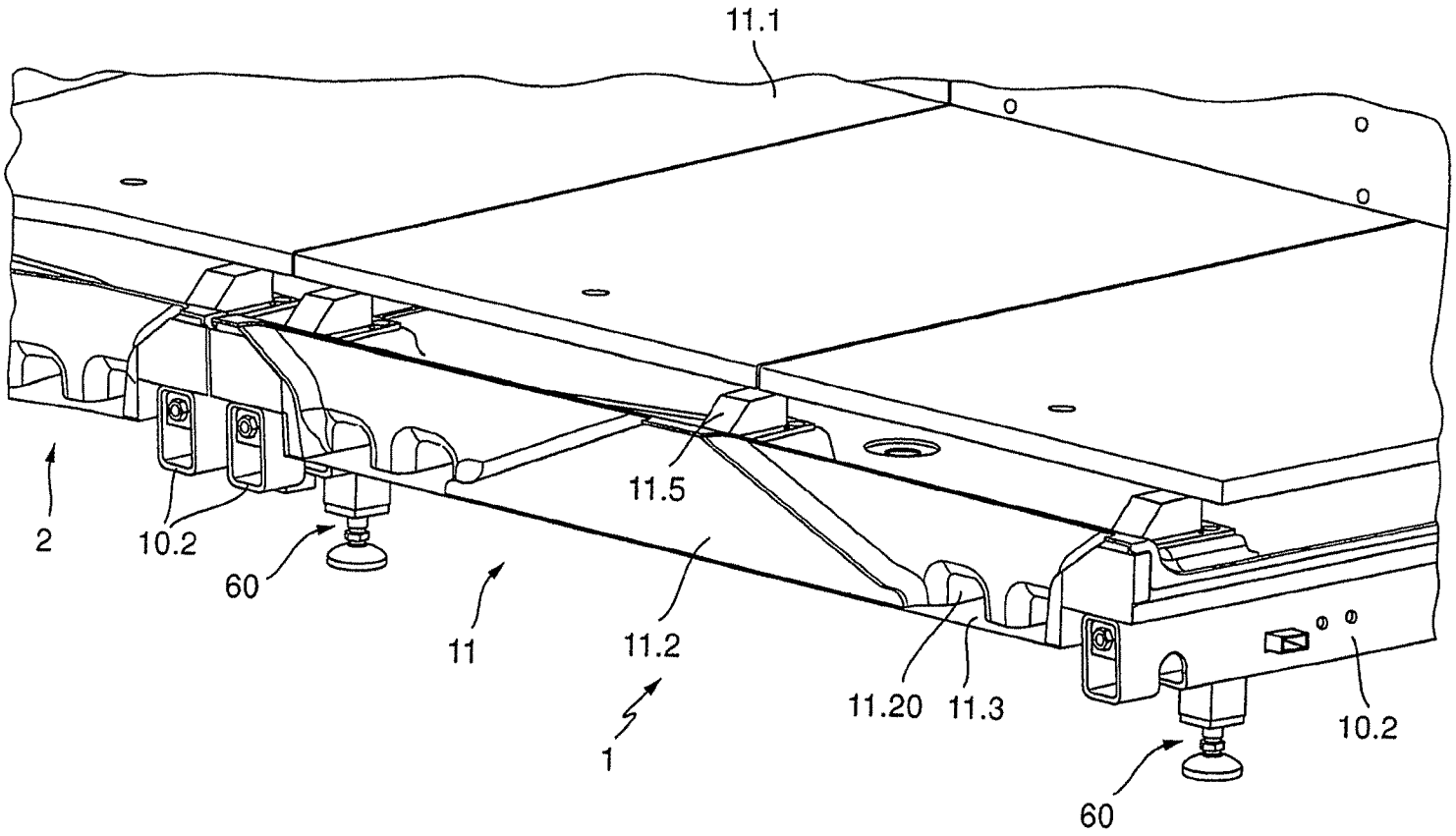
FIG. 6 shows a front, bottom corner region of a cooling unit system in a perspective view obliquely from the front, above, and to the side.
Figure 7:
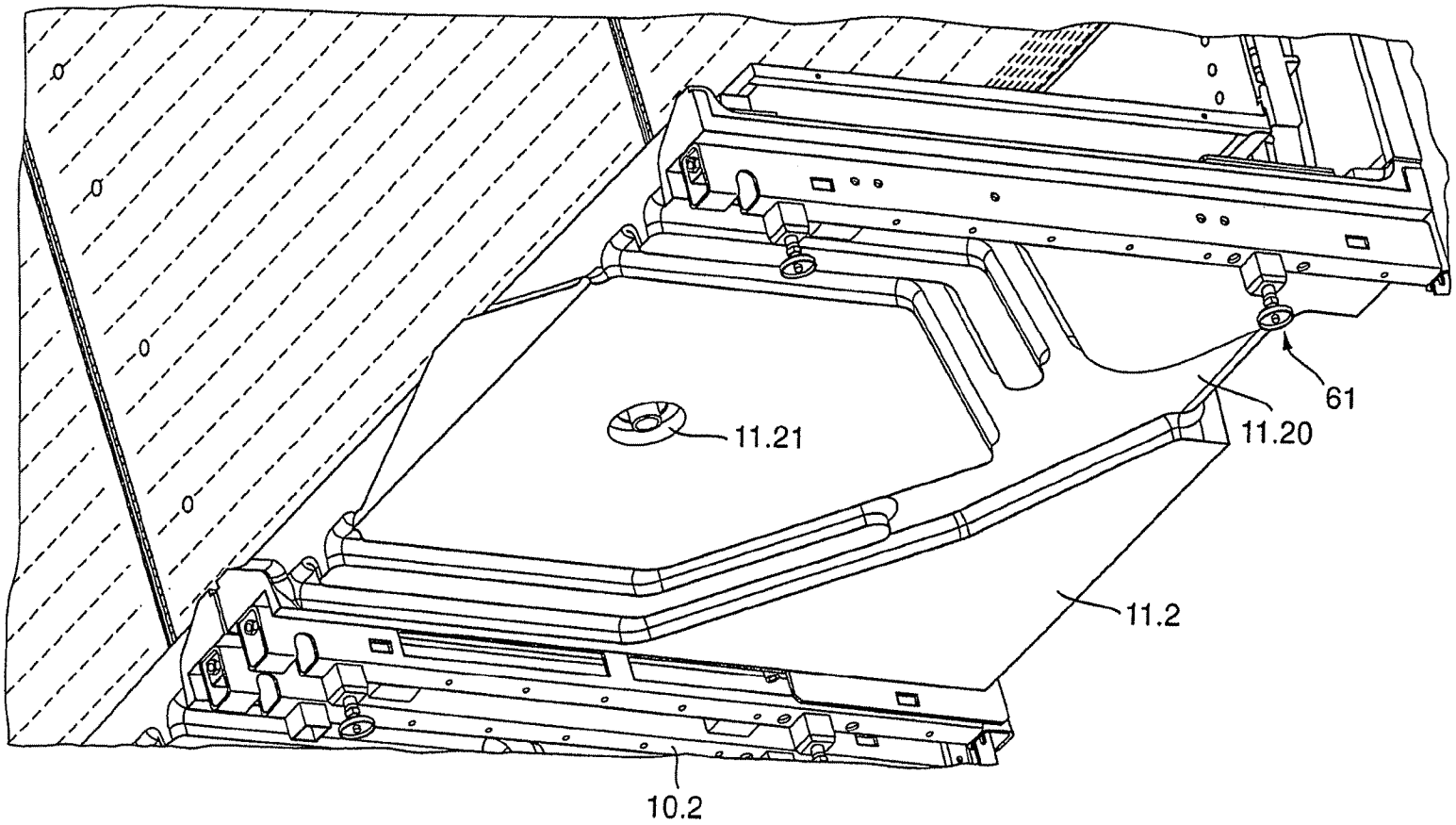
FIG. 7 shows a bottom corner region of a cooling unit system with the bottom base plate removed, in a perspective view obliquely from the front, below, and to the side.

As shown in greater detail from FIGS. 5, 6, and 7, the floor cover 11.1 is placed onto a plurality of block-shaped support elements 11.5 in the front region, such as plastic blocks composed of or comprising hard plastic, and are placed onto other support elements in the rear region, which are embodied, for example, in the form of support angles with forward-protruding support legs, particularly embodied in the form of an angled strip mounted to the lower section of the support profiles 10.4 of the two side frames 10.

Under the intermediate space 11.6 situated beneath the floor cover 11.1, there is a deflector plate 11.2 composed of or comprising heat-insulating and sound-insulating material, the top of which simultaneously serves as a catch basin for liquid that forms and has a drain hole 11.21, to which a drainpipe system is connected. On the underside, the deflector plate 11.2 is provided with a system 11.20 of molded conduits by which, beneath the deflector plate 11.2, a lower, outer horizontal intermediate space is embodied in the form of a lower, outer air flow conduit 11.7, which is covered at the bottom by a base plate 11.3 or a plurality of partial base plates or cover plates on the underside of the base group 11.

As shown in FIGS. 6 and 7, a plurality of conduits of the system 11.20 of molded conduits leading from respective inlet openings 11.70 are brought together at the rear of the deflector plate 11.2 on its underside and transition via a relatively wide recess or molded area of the deflector plate 11.2 into a rear, outer vertical intermediate space or outer vertical flow conduit 12.5 of the rear wall group 12 fluidically connected to them, which is embodied between the front side of the outer casing 12.3 and an intermediate partition with an intermediate wall 12.2 between the outer casing 12.3 and the inner cover 12.1, as is also shown by FIG. 3 and partially by FIG. 10. In order to produce the transition between the lower outer air flow conduit 11.7 and the lower section of the outer vertical flow conduit 12.5, the lower region of the relatively thick-walled insulating outer casing 12.3 can be cut out and, for example, only a thin cover plate can be left, which covers an insulation layer of the outer casing 12.3 on the back side. The recess in the insulating outer casing 12.3 can, for example, be produced by subsequently cutting it out from the front, thin cover plate and the insulation layer or even during the manufacture by leaving this region free during the foaming and recessing of the front cover plate. In this way, the transition and a lower section of the vertical outer flow conduit 12.5 can be suitably positioned and can pass, for example, downstream of the lower fan 57 and to one side of a compressor accommodated in the lower region of the rear wall group 12 (see FIG. 1). Then, the vertical outer flow conduit 12.5 is spread out toward the top over the entire width of the rear wall group 12 by baffle elements.

Figure 8:
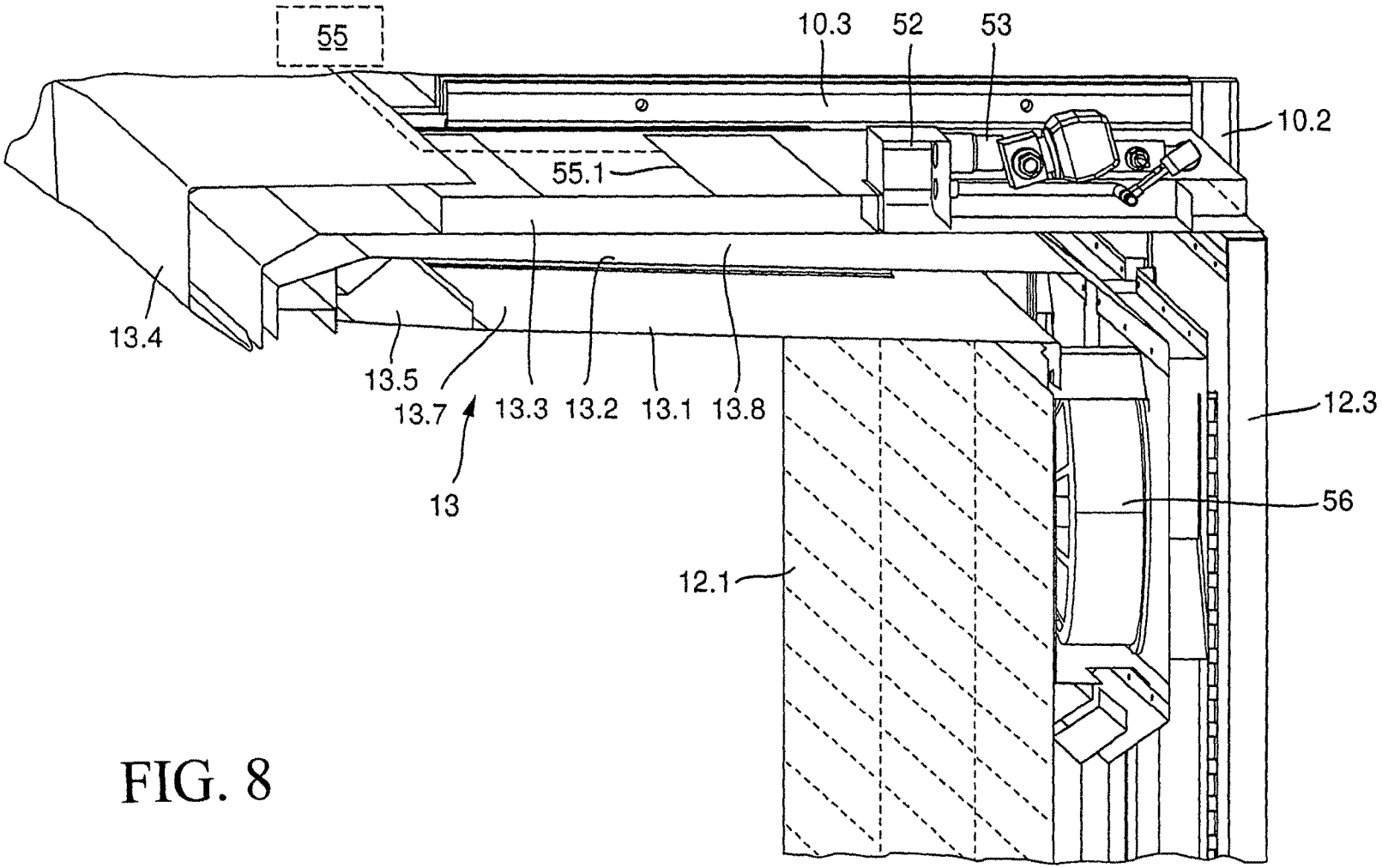
FIG. 8 shows an upper section of a shelving module, in a perspective view obliquely from the front, above, and to the side.
Figure 9A:
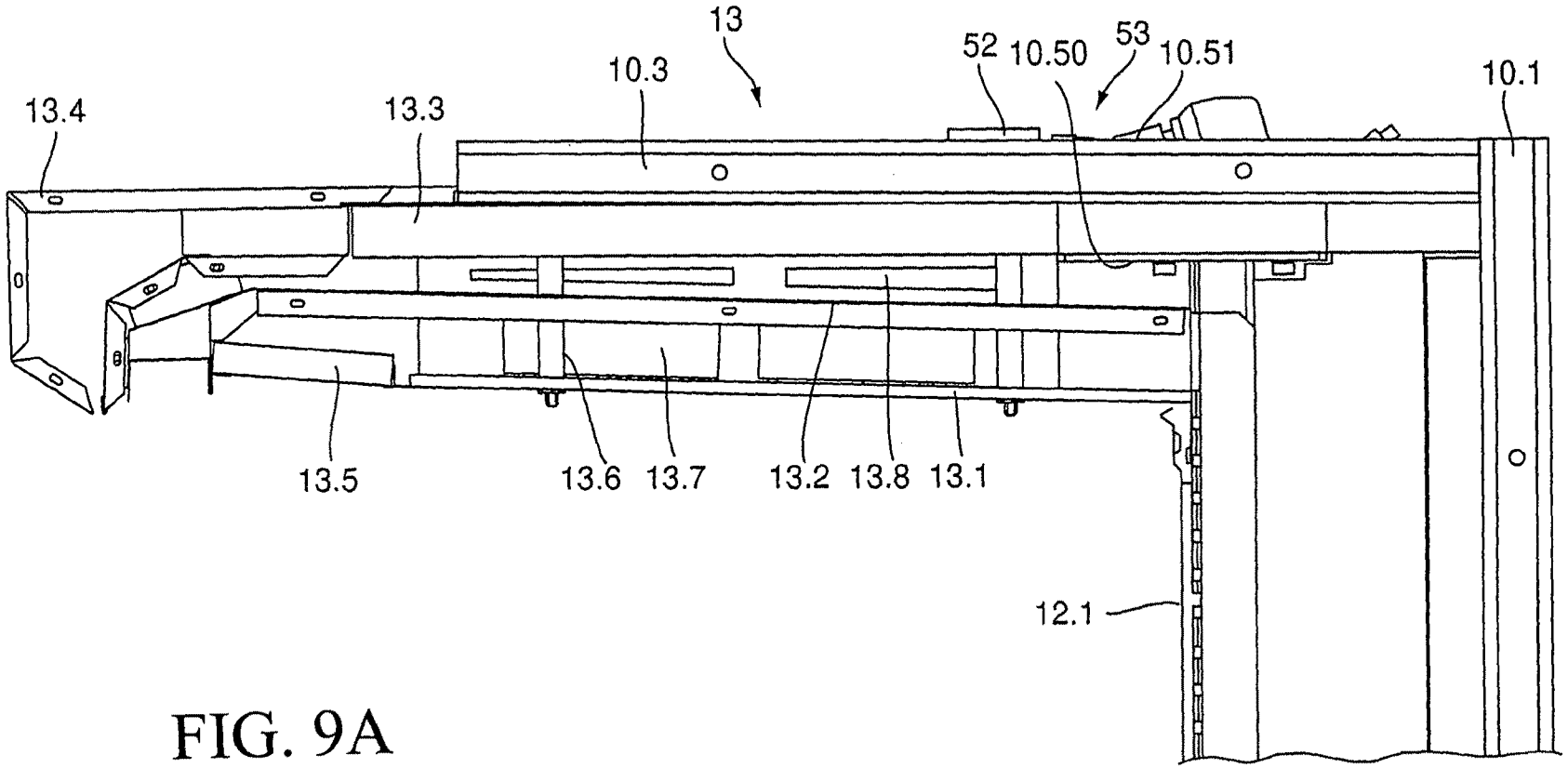
FIG. 9A shows an open side view of an upper section of a shelving module.

The fan 57 situated in the lower region of the rear wall group 12 is situated in the outer vertical intermediate space or in the vertical outer flow conduit 12.5 formed by it, which extends upward through the intermediate partition with the intermediate wall 12.2 behind the evaporator 50, 50', 50" and in front of the outer casing 12.3 and is connected to an outer upper intermediate space or outer upper flow conduit 13.8, forming a fluidic connection, as is clear from FIGS. 8 and 9A in connection with FIG. 10. In the upper group 13, the outer upper flow conduit 13.8 is divided from the inner upper flow conduit 13.7 by an intermediate cover 13.2 and extends between the intermediate cover 13.2 and the underside of the upper cover 13.3 to the front top section 13.4 and exits from the latter through an outlet slit 13.80 provided on the underside, spaced apart from the outlet opening 13.50 with the outlet grating 13.5, in order to form, on the front side of the relevant shelving module 1, 2, 3 or cooling unit system, a warm air curtain 71 situated in front of the cold air curtain 70. In the front region of the base group 11, the air flow produced by the warm air curtain 71 enters a slit-like inlet opening situated in front of the cover grating 11.10, into the lower outer intermediate space or lower outer flow conduit in order to form a warm air circuit.

As shown in FIGS. 9A and 10, the lower cover 13.1, the intermediate cover 13.2, and the upper cover 13.4 in the upper group 13 are held apart from one another by a plurality of jointly used support pins 13.6 in order to form the inner upper intermediate space 13.7 and the outer upper flow conduit 13.8. The upper cover 13.3 in this case is embodied in a thermally insulated way in the form of an insulating plate composed of or comprising insulation, for example in a way that corresponds to that of the outer casing 12.3. The insulating cover 13.3, together with the insulating outer casing 12.3 of the rear wall group 12 and the insulating deflector plate 11.2 of the base group 11, forms a shell-like thermal insulation.

In the exemplary embodiment shown, the insulating outer casing 12.3 of the rear wall group 12, the insulating upper cover 13.3 of the upper group 13, and the insulating deflector plate 11.2 of the base group 11 are each mounted to the inside of the vertical profile 10.1 oriented toward the cooling chamber 4, to the upper horizontal profiles 10.3, and to the lower horizontal profiles 10.2, respectively, of the associated side frames 10. At least on the inside oriented toward the cooling chamber numeral 4, the outer casing 12.3 is provided with a stable covering or is entirely embodied in the form of a stable, load-bearing plate so as to permit the intermediate wall 12.2 of the intermediate partition to be mounted thereon in a stable fashion, for example by a vertical spacer profiles that have an H-shaped cross-section, with the relevant spacing for the outer vertical intermediate space. The intermediate wall 12.2 can be bent at the vertical edges, such as in a Z shape, with end sections protruding outward in a flange-like fashion, and can be fastened to the side of the outer casing 12.3 oriented toward the cooling chamber 4, such as by screws or rivets.

The intermediate wall 12.2, which is composed of or comprises sheet steel or another suitable metal, offers a stable support base for the attachment of the evaporator 50, 50', 50", which advantageously extends across a plurality of shelving modules 1, 2, 3, as described above. The evaporator 50, 50', 50", which can be composed of or comprises sections associated with the shelving modules 1, 2, 3, is thus situated in the region of the cooling air conduit in front of the warm air conduit and is mounted there in stable fashion by connectors of the receiving device, such as by fastening screws and fastening lugs. In an evaporator 50, 50' 50" extending across a plurality of shelving modules 1, 2, 3, there is enough space provided at least on one side, (for example, see FIG. 1) so that connectors can be placed in this region for connecting lines for the refrigerant supply and for the injection of the refrigerant, such as a plurality of injection valves of the injection system, for the evaporation. The evaporator 50, 50', 50" in this case is not fastened to the frame profiles or support profiles so that on the one hand, no thermal transmission to the outside via the frame occurs and on the other hand, the support profiles 10.4 can be installed and removed without hindrance.

In alternative exemplary embodiments, in lieu of an evaporator for the cooling, it is also possible for another heat exchanger to be built into the rear wall group 12 or the upper region of the cooling unit, with the refrigerant advantageously being cooled in a remotely positioned central heat exchanger (such as with a water chiller).

Figure 9B:
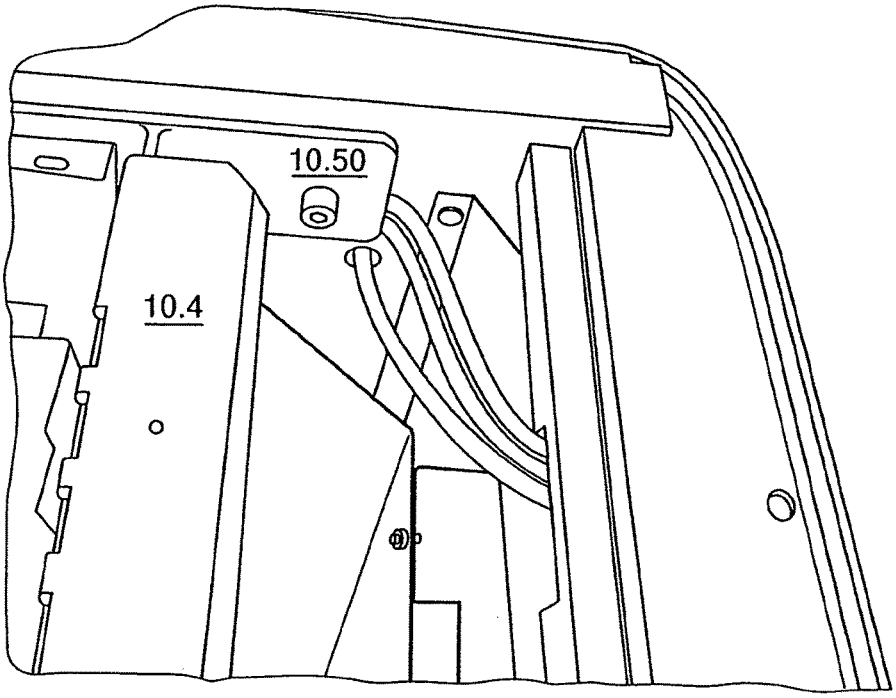
FIGS. 9B and 9C show an upper and lower corner region, respectively, of a shelving module in a perspective view.
Figure 9C:
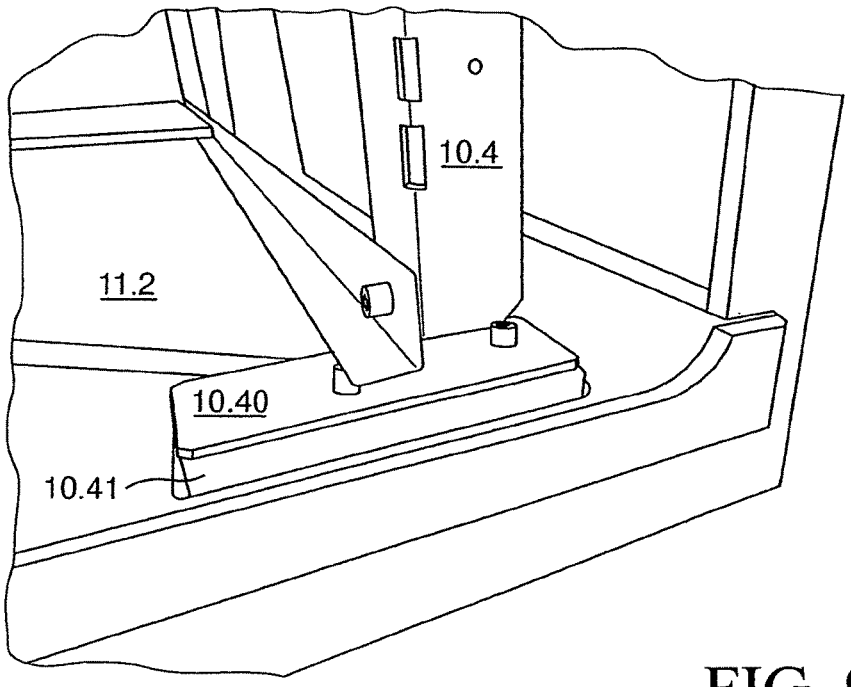

The support profile 10.4 is screwed to and supported on the underside of the upper horizontal profile 10.3 of the side frame 10 in stable fashion by an intermediate piece that is elongated from front to back and an upper support plate 10.50 (see FIG. 9B). As already shown in FIG. 5 and illustrated in FIGS. 9B and 9C, on its underside, the support profile 10.4 is supported by a support plate 10.40 that extends from front to back relative to the top of the lower horizontal profile 10.2 of the relevant side frame 10. Advantageously, an intermediate piece 10.41 made of hard plastic is inserted, which produces both a thermal insulation and a sound installation. This attachment permits the support profiles 10.4 to be easily installed and removed. In this case, the fastening elements for attaching the intermediate pieces to the horizontal profiles 10.2, 10.3 on the one hand and for attaching the support plate 10.40, 10.50 of the support profiles 10.4 to the intermediate pieces on the other hand are offset so that no continuous metallic thermally conductive contact is produced between the support profile 10.4 and the horizontal frame profiles 10.2 and 10.3.

The metallic support profiles 10.4 are provided with rows of holes in a predetermined, preferably standardized, spacing pattern, in which the plates of the inner cover 12.1 of the rear wall group 12 are accommodated so that they can be easily hooked and unhooked. In addition, support arms for the shelves can easily be hooked into the support profiles at the desired height.

Anti-tipping devices 62 protruding downward are mounted at the lower end section of the vertical profiles 10.1, which advantageously permit an adaptation to uneven floors, for example by resilient or elastic intermediate elements and/or adjusting elements. A lighting device 64 can be positioned in the front region of the base group 11 and/or upper group 13. Advantageously, a roller curtain 63 is situated in the front, upper region in order to close the cooling chamber at the front, for example during non-business hours, and thus to save cooling energy.

Sealing components are installed at the sides in order to seal the intermediate spaces in the base groups 11, rear wall groups 12, and upper groups 13 of the shelving modules 1, 2, 3.

In this case, the sealing components are advantageously inserted, for example, between the adjacent outer casings 12.3, the upper covers 13.3, and particularly also between the deflector plates 11.2. Additional sealing elements can in fact or solely be situated between the side frames 10 of adjacent shelving modules 1, 2, 3 aligned next to one another in order to seal the cooling chamber 4 between the shelving modules 1, 2, 3, but the side frames 10 are clamped to one another in a stable fashion and with a definite positioning, preferably only by interposed spacer elements such as spacer sleeves. Various embodiments of sealing elements can be used for the sealing components, for example sealing strips with a mushroom-shaped cross-section and leaves. In addition, with adapted sealing components, side walls can be attached to the side frames 10 in a corresponding fashion, such as can be attached to the narrow edges of the outer casing 12.3, to the lower cover 13.3, and to the deflector plates 11.2 in a sealed fashion at the respective connecting edge.

Various lateral partitioning elements can be used for laterally sealing the inner intermediate spaces 11.6, 12.4, 13.7 for the cold air flow and the outer flow conduits 11.7, 12.5, 13.8 for the warm air flow. In an exemplary embodiment that has been tested, with a plurality of shelving modules 1, 2, 3 in a row, the inner intermediate spaces 12.4 of the rear wall group 12 are continuously connected to one another across the entire cooling unit system and only terminated in a sealed fashion at the two ends of the cooling unit system by relevant partitioning elements. This has one advantage of not hindering the use of a continuous evaporator 50', 50". By contrast, in an advantageous embodiment, the inner intermediate spaces 11.6 and 13.7 of the base group 11 and upper group 13 are partitioned on both sides of each shelving module 1, 2, 3 and are connected to the vertical, inner intermediate space 12.4 by appropriate air baffle plates in order to avoid disadvantageous flow leakages. The inner cover 12.1 of the rear wall group 12 is supplemented by intermediate plates in the transition region between the aligned shelving modules 1, 2, 3.

In the tested exemplary embodiment, the outer flow conduits 11.7, 12.5, 13.8 are respectively partitioned for each shelving module 1, 2, 3. In the rear wall group 12, this occurs in the region of or near the intermediate wall 12.2, for example by its lateral edges or by inserted strips, and correspondingly also in the region of the upper group 13 and in the region of the base group 11, for example by the molded indentations on the underside of the deflector plate 11.2.

Figure 11A:
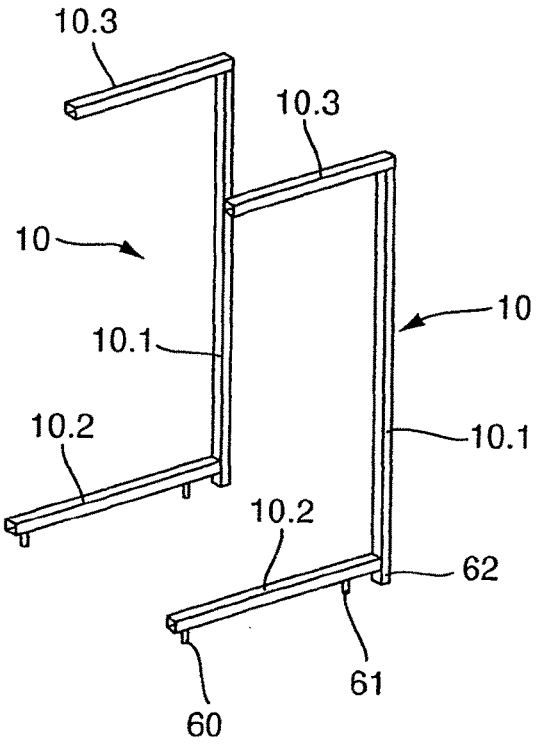
FIGS. 11A through 11X show different depictions of assembly steps of a shelving module according to different embodiments of this invention.
Figure 11B:
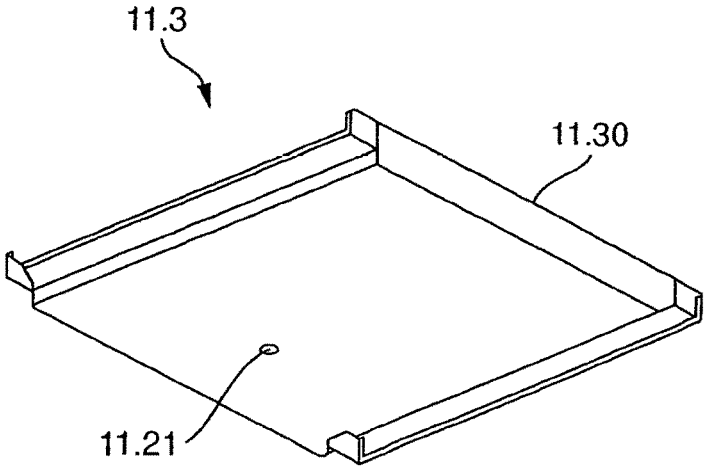
Figure 11C:
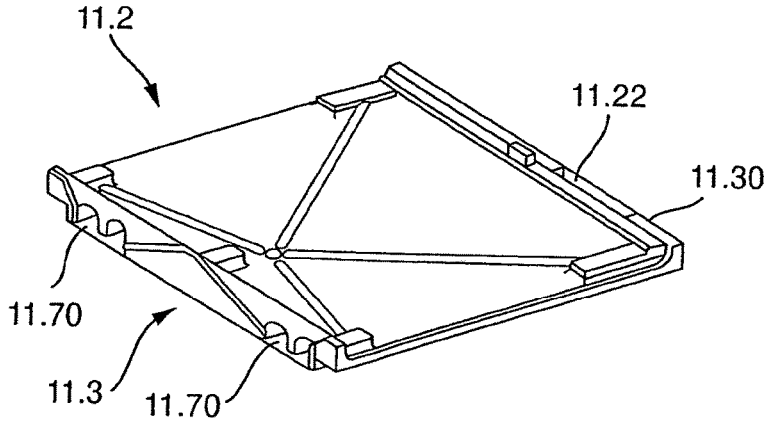
Figure 11D:
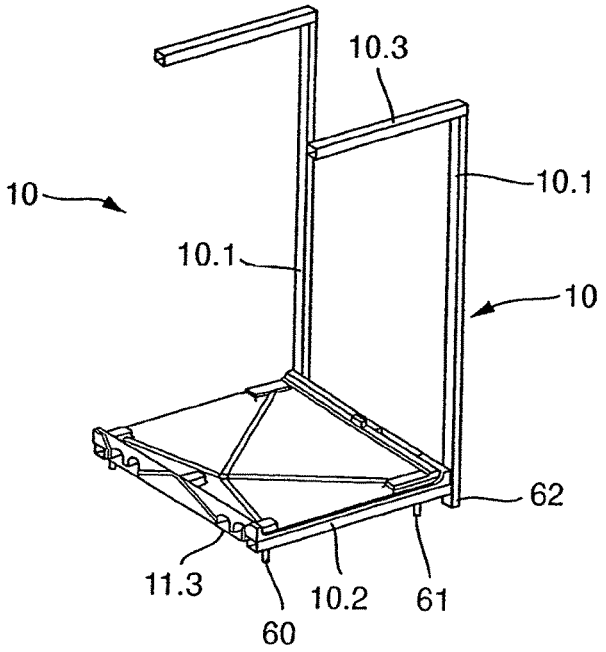
Figure 11E:
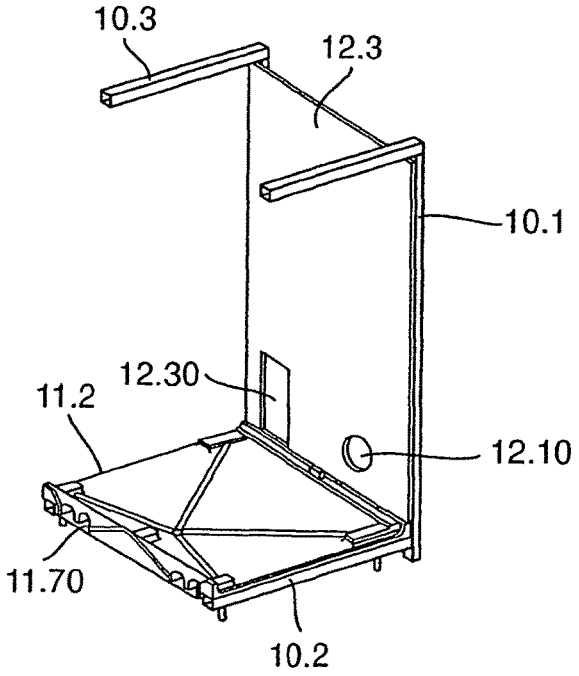
Figure 11F:
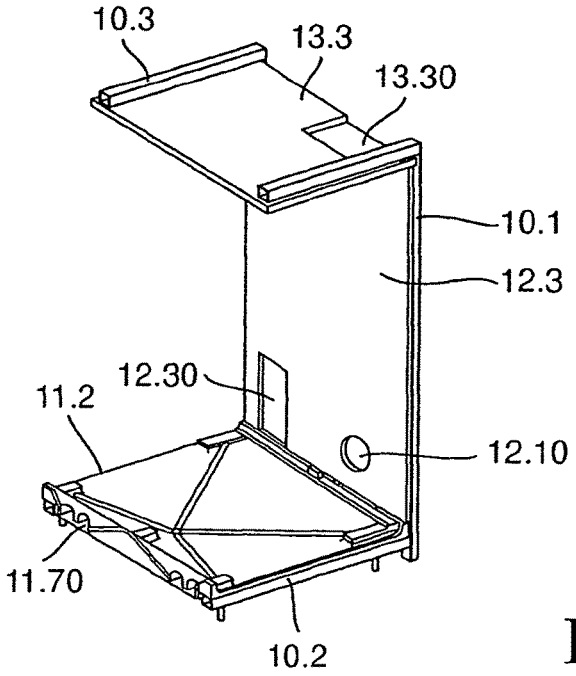
Figure 11G:
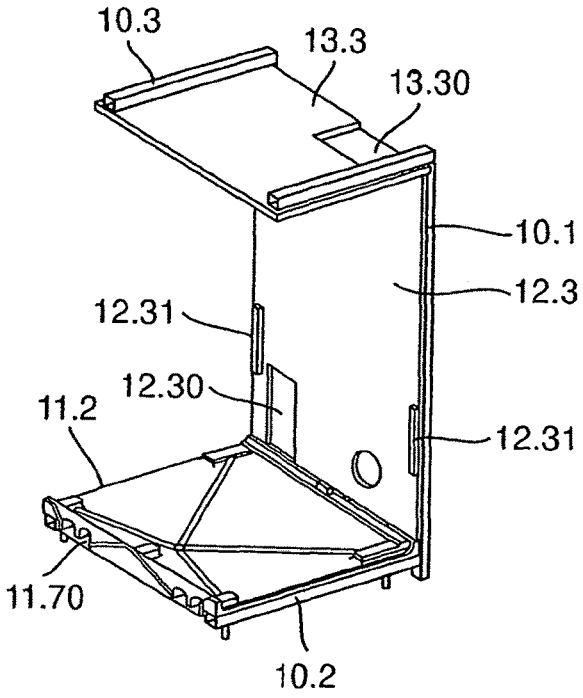
Figure 11H:
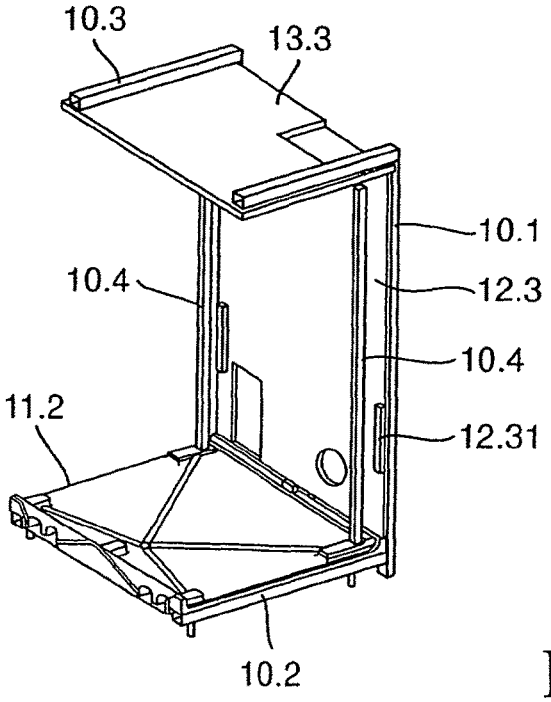
Figure 11I:
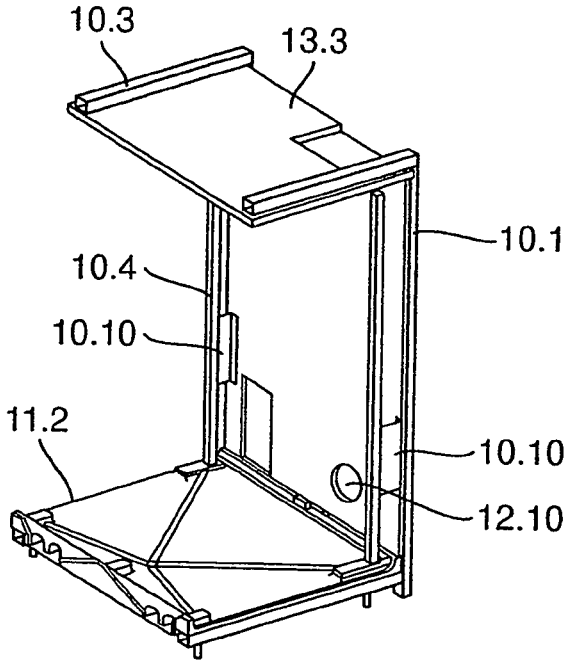
Figure 11J:
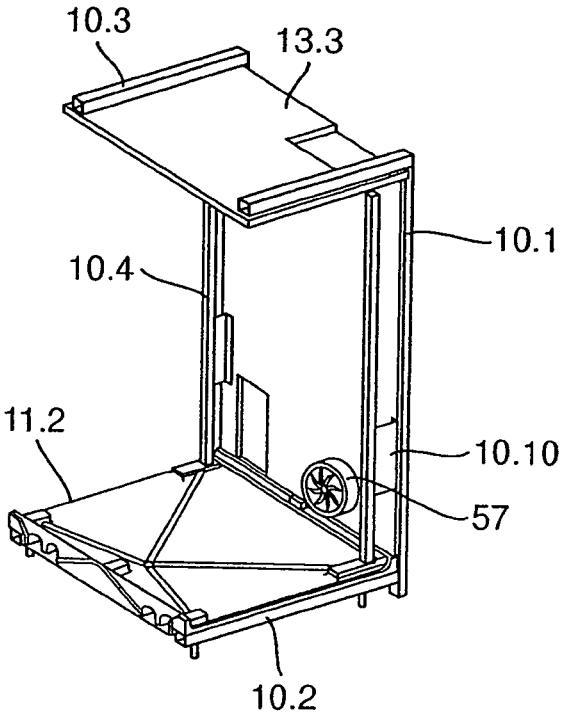
Figure 11K:
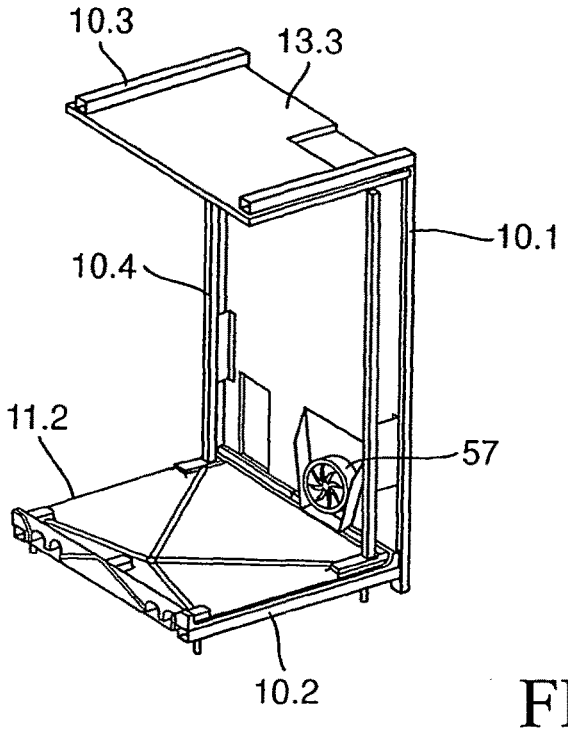
Figure 11L:
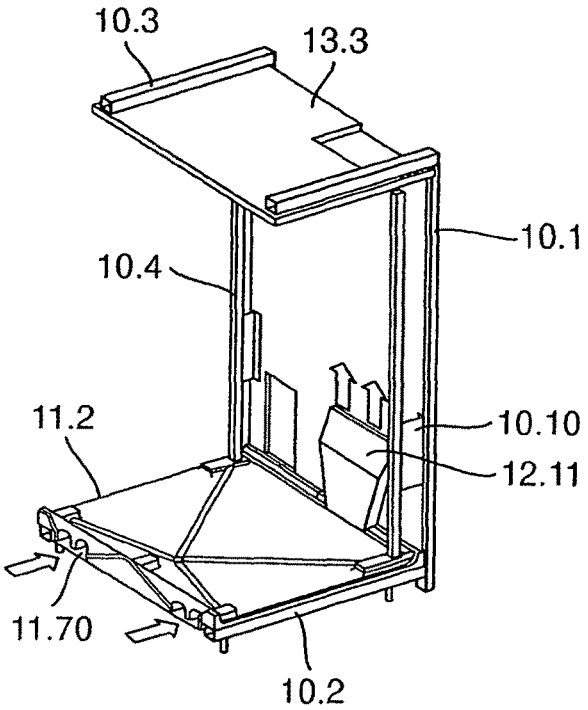
Figure 11M:
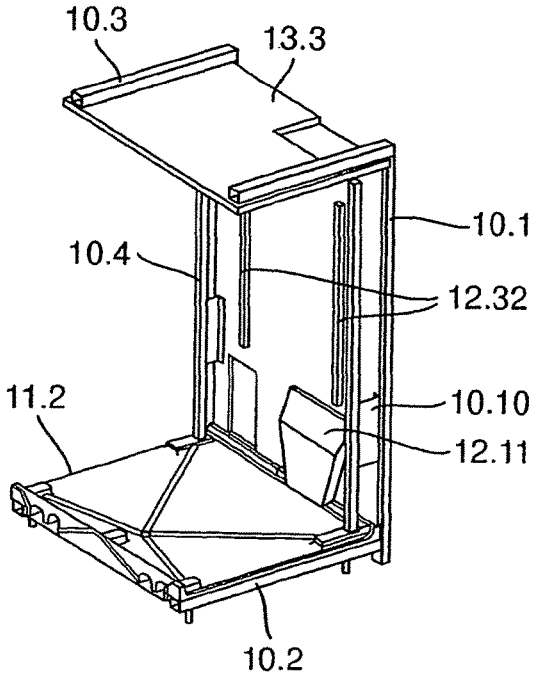
Figure 11N:
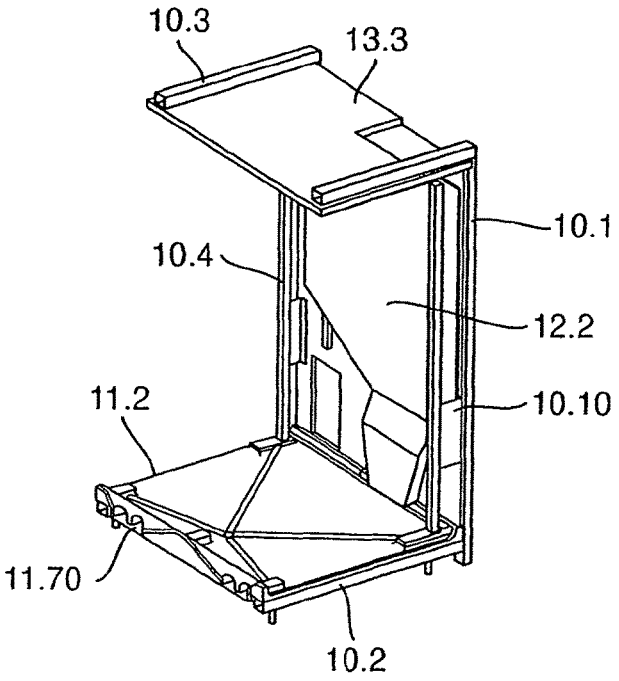
Figure 11O:
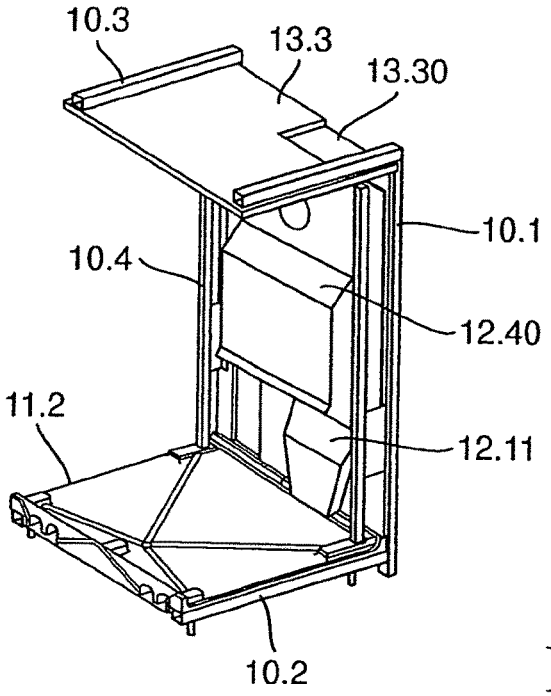
Figure 11P:
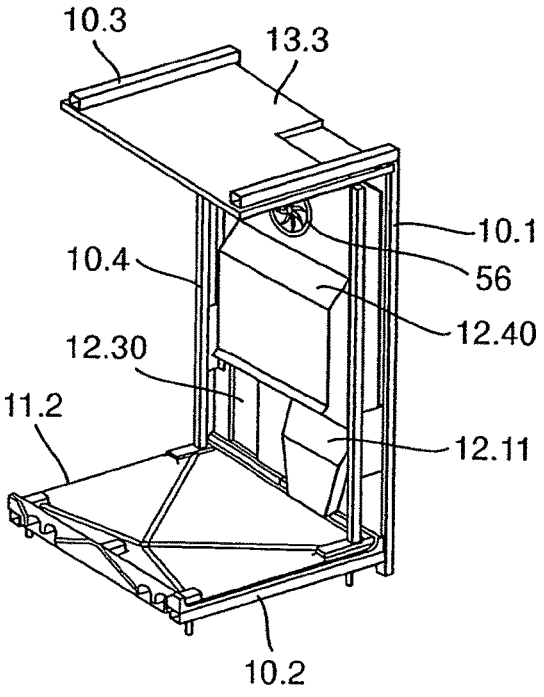
Figure 11Q:
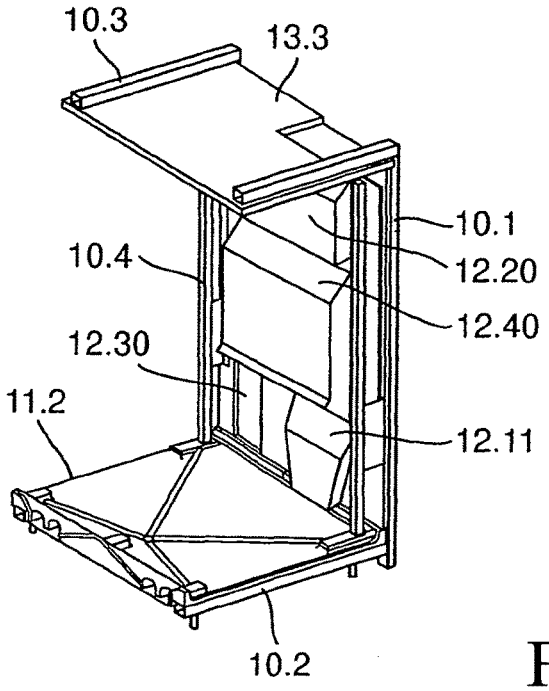
Figure 11R:
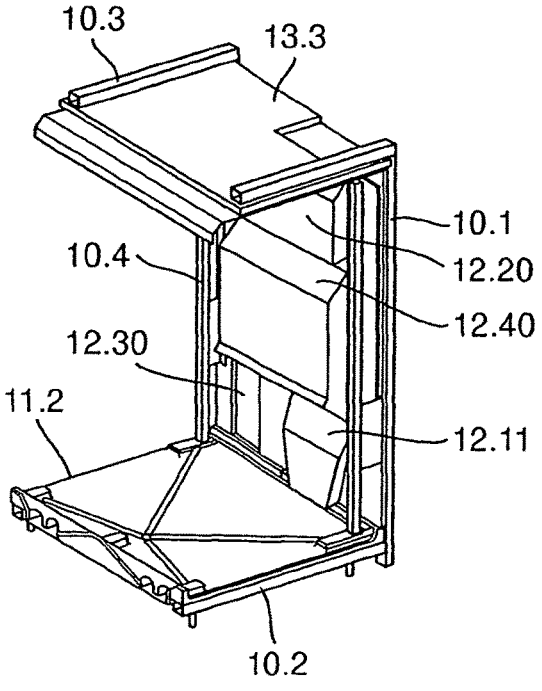
Figure 11S:
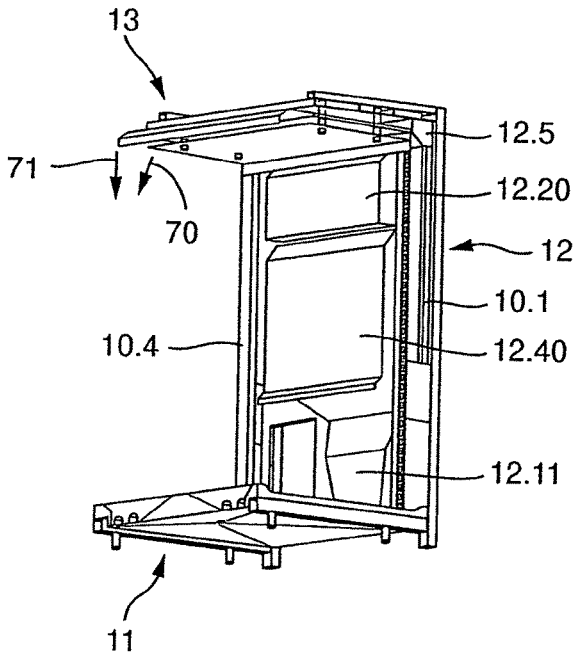
Figure 11T:
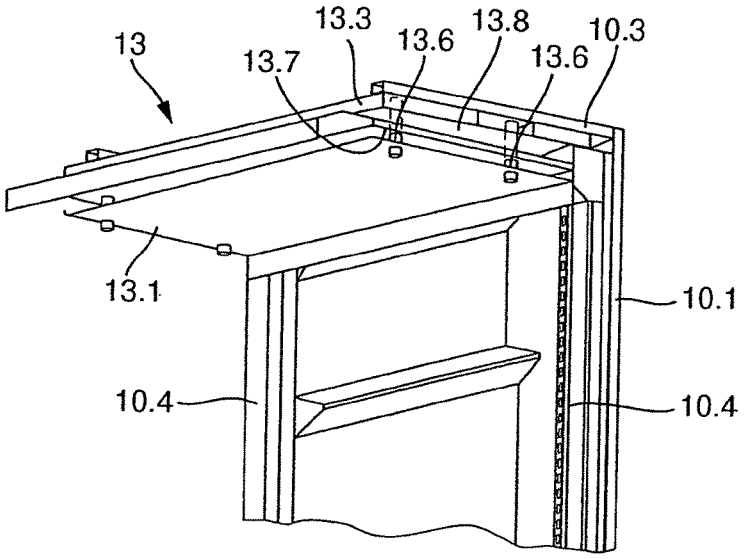
Figure 11U:
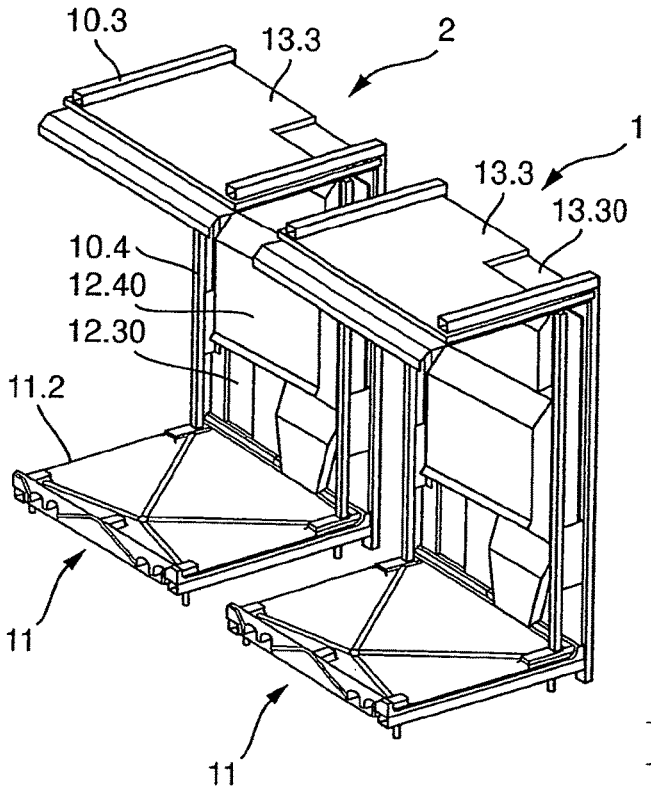
Figure 11V:
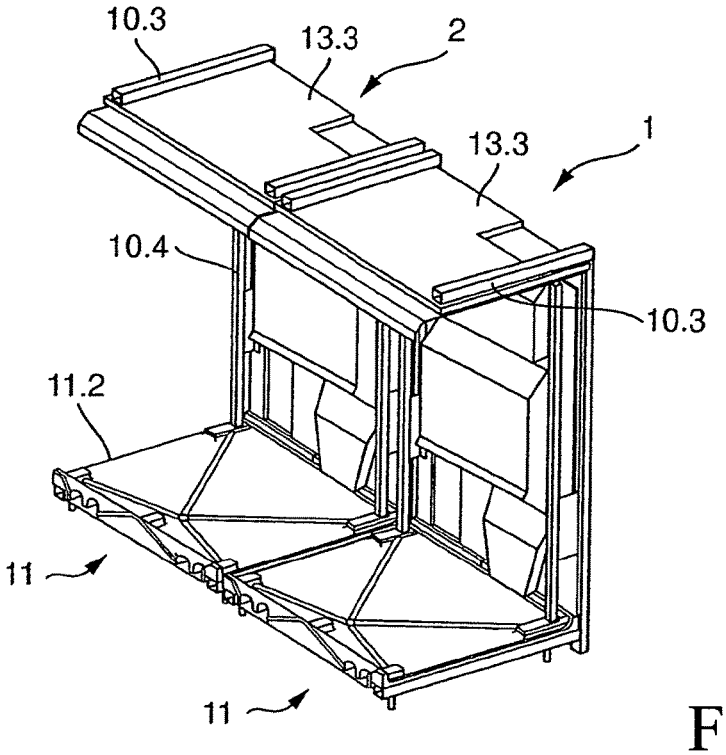
Figure 11W:
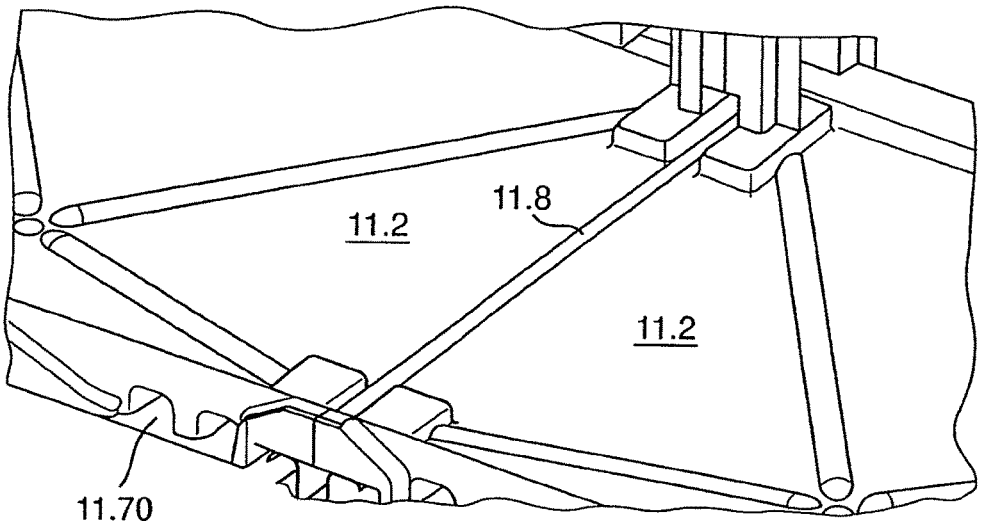
Figure 11X:
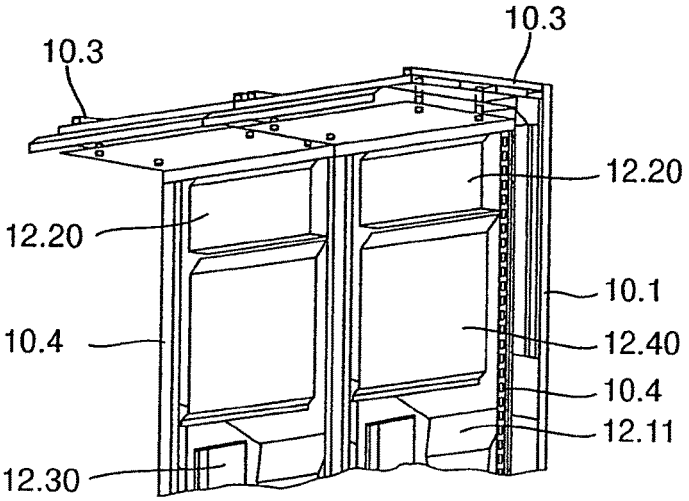

FIGS. 11A through 11X show one exemplary embodiment for successive assembly steps of constructing a shelving module 1, 2, 3 or cooling unit as well as a system composed of or comprising two shelving modules. If so desired, individual assembly steps here can also be omitted, changed, or swapped.

First, according to FIG. 11A, two side frames 10 are each produced from a vertical profile 10.1, a lower horizontal profile 10.2 protruding forward in the vertical profile's lower region, and an upper horizontal profile 10.3 protruding forward in the vertical profile's upper region. The undersides of the lower horizontal profiles 10.2 are provided with height-adjustable feet 60, 61 and at the lower end of the vertical profiles 10.1, the anti-tipping device 62 protrudes downward. In the exemplary embodiment shown, the upper horizontal profile 10.3 is embodied as shorter than the lower horizontal profile 10.2, but in a likewise advantageous embodiment, the upper horizontal profile 10.3 can be embodied as exactly the same length or longer than the lower horizontal profile 10.2, in order to be able to attach the upper group 13 in a stable fashion. The two side frames 10 are embodied as spaced apart from each other in accordance with the width of the shelving module 1, 2, 3.

In another step (FIG. 11B), the base plate 11.3 as the lower cover of the base group 11 is provided with a back side 11.30 that is to be turned toward the vertical profiles 10.1 and the drain hole 11.21. This covers the underside of the deflector plate 11.2 with the molded conduits 11.20, as shown in the subsequent assembly step according to FIG. 11C. In lieu of the base plate 11.3, however, the molded conduits 11.20 can also be separately covered and advantageously sealed by one or more partial plates. As also shown in FIG. 11C, the molded conduit 11.20 that is composed of or comprises, for example, a plurality of sub-conduits feeds into a relatively wide slit-like outlet opening 11.22 situated on one side of the back of the deflector plate 11.2, opens upward and is delimited on the back side by a bending of the base plate 11.3 or a partial plate. The drawing also shows the inlet openings 11.70 of the molded conduit 11.20.

In a subsequent step according to FIG. 11D, the thus-prepared deflector plate 11.2 is placed onto the lower horizontal profiles 10.2 and fastened.

Then according to FIG. 11E, the thermally insulating outer casing 12.3 is mounted onto the front side of the vertical profiles 10.1. In the lower region, the outer casing 12.3 is provided with a compressor opening 12.30 extending through it for subsequent installation of the compressor, which is situated next to the outlet opening 11.22 of the deflector plate 11.2. Above the outlet opening 11.22, a lower fan opening 12.10 is provided in the outer casing 12.3, but is covered on the back side of the outer casing 12.3 such as with a thin covering layer of the outer casing 12.3 or a separate plate and forms a conduit for the air flow from the outlet opening 11.22 of the lower fan 57 to be subsequently installed.

In another step, the upper cover 13.3 is mounted to the underside of the upper horizontal profiles 10.3 (FIG. 11F). In the exemplary embodiment shown, the upper cooling component receptacle 13.30 is cut out from the right, rear of the top side of the upper cover 13.3, leaving only a lower covering layer of the thermally insulating upper cover 13.3.

In the next step shown in FIG. 11G, spacers 12.31 are fastened to the front side of the outer casing 12.3 in the vicinity of or near the vertical edges.

Then, the support profiles 10.4 are installed between the upper and lower horizontal profiles 10.3, 10.2, in their rear region, spaced apart from and parallel to the front side of the vertical profiles 10.1, using the support plates 10.40, 10.50 and the insulating intermediate pieces between the underside of the upper cover 13.3 and the top side the deflector plate 11.2 (FIG. 11H).

In the next step of the method (FIG. 11I), fixing parts 10.10 are mounted, if necessary, between the support profiles 10.4 and the vertical profiles 10.1, for stiffening purposes or to serve as holding elements, but can also be omitted if the supporting force is sufficient.

In a subsequent step (FIG. 11J), the lower fan 57 is mounted in front of the lower fan opening 12.10 and in subsequent steps, is enclosed with a fan housing 12.11 (FIGS. 11K and 11L) in order to form the lower region of the outer vertical flow conduit.

In another step (FIG. 11M), the front side of the outer casing 12.3 has strip-like vertical spacers 12.32 mounted onto it, onto which the intermediate wall 12.2 is mounted, spaced apart from the outer casing 12.3 to form the upper region of the vertical flow conduit, producing a connection to the upper opening of the fan housing 12.11 (FIG. 11N).

A plate-like cooling air baffle plate 12.40 is mounted onto the intermediate wall 12.2 and spaced apart from it, behind which the evaporator 50, 50', 50" (not shown) or another heat exchanger is placed. In addition, the upper fan 56 is mounted on a plate that is spaced apart from the intermediate wall 12.2 (FIGS. 11O and 11P). The upper fan 56 or instead of it, a plurality, such as two, upper fans situated next to one another, each is covered by an upper fan cover 12.20 in a housing-like fashion. Cooling air flowing upward out of the evaporator 50, 50', 50" or heat exchanger is taken in by the upper fan 56, for example in the axial direction, and conveyed away in the radial direction, in fact with one partial flow traveling downward on the inside of the cooling air baffle plate 12.40 oriented toward the cooling chamber 4 and one partial flow traveling upward into the upper, inner intermediate space 13.7 of the correspondingly added upper group 13 (FIGS. 11Q and 11R). The housing-like upper fan cover 12.20 is embodied to route the air flow in the desired direction and with the desired intensity and can also be provided with an intermediate partition between two fans 57 in order to avoid a reciprocal influence (such as short-circuiting). For example, outflow openings of a calibrated size can be provided in the fan cover 12.20, toward the top and bottom and also toward the front if so desired.

The outer vertical flow conduit 12.5 is also connected to the relevant outer upper flow conduit 13.8 of the upper group 13, after which the outer upper flow conduit 13.8 and the upper intermediate space 13.7 in the upper group 13 are produced using the support pins 13.6 (FIGS. 11S and 11T). In this case, the slit-like outlet opening 13.50 and the outlet slit 13.80 for the cold air curtain 70 and the warm air curtain 71 are also provided in the front, lower region of the upper group 13.

In other steps, a cooling unit system is constructed, such as out of two shelving modules 1, 2, as shown in FIGS. 11U, 11V, 11W, and 11X. In these steps, the side frames 10 on the vertical profiles 10.1, the lower horizontal profiles 10.2, and/or the upper horizontal profiles 10.3 are clamped to each other in a definite relative position with the interposition of spacer elements such as spacer sleeves and are sealed along the narrow edges that face one another on their outer casings 12.3, deflector plates 11.2, and upper covers 13.3 with the interposition of scaling elements such as sealing strips 11.8 with a mushroom-shaped cross-section.

The invention claimed is:

1. A cooling unit system including a cooling device (5) and at least two shelving modules (1, 2, 3) that can be aligned in a row and in an identical fashion, having a base group (11), a rear wall group (12), and an upper group (13) with respective casing parts and forming a cooling chamber (4); the shelving modules (1, 2, 3) having identical module frames with frame profiles which support the base group (11), the rear wall group (12), and the upper group (13); and at least the rear wall group (12) of each shelving module (1, 2, 3) equipped with components of the cooling device (5), the cooling unit system comprising: the module frames with the frame profiles forming side frames (10) of the shelving modules (1, 2, 3) and the base group (11), the rear wall group (12), and the upper group (13) mounted to the side frames (10) with their respective casing parts, the cooling device (5) including at least one compressor (51), an evaporator (50, 50', 50"), a condenser (52), connectors (53) including connecting lines (53.1), a fan (56, 57), and a control device with a control unit (55.1), the evaporator (50, 50', 50") disposed in the rear wall group (12) and extending through and being shared by each of several or all of the shelving modules (1, 2, 3), and the rear wall group (12), the base group (11), and/or the upper group (13) of each shelving module (1, 2, 3) embodied for detachable installation of other components of the cooling device 5.

2. The cooling unit system according to claim 1, wherein only some of the shelving modules (1, 2, 3) has a compressor (51) and/or a control unit (55.1).

3. The cooling unit system according to claim 2, wherein the cooling device is connected via connecting lines to a central heat exchanger (54).

4. The cooling unit system according to claim 3, wherein in the rear wall group (12) between a thermally insulating outer casing (12.3) and an inner cover (12.1) that adjoins the cooling chamber (4) at the back and has ventilation openings, a vertical intermediate space is provided, the vertical intermediate spaces of adjacent shelving modules (1, 2, 3) complement one another to form a combined intermediate space extending continuously across an entire width of the cooling unit system, the intermediate space is closed in a sealed fashion at the lateral ends, and the evaporator (50, 50', 50") extends in the combined intermediate space.

5. The cooling unit system according to claim 4, wherein the evaporator (50, 50', 50") is fastened to adjacent vertical profiles (10.1) and/or to the front side of a flat intermediate partition.

6. The cooling unit system according to claim 5, wherein a receiving device for each shelving module (1, 2, 3) or for only one of the shelving modules (1, 2, 3) and for the detachable installation of the cooling components of the cooling device 5 has in a lower region of the rear wall group (12) a receiving chamber for a compressor (51) and has in the rear wall group (12) or in or on the upper group (13) a receiving part for the control unit (55.1) and/or a condenser (52).

7. The cooling unit system according to claim 6, wherein the compressor (51) and the control unit (55.1) are situated in the same shelving module (1, 2, 3).

8. The cooling unit system according to claim 7, wherein in addition, only one condenser (52) is in the cooling unit system for the part of the group of shelving modules (1, 2, 3) or for all of the shelving modules (1, 2, 3) and is situated in the same shelving module (1, 2, 3) as the compressor (51) and the control unit.

9. The cooling unit system according to claim 8, wherein the side frames (10) each has a rear vertical profile (10.1), a lower horizontal profile protruding forward from it at the bottom, and an upper horizontal profile protruding forward from it at the top (10.2, 10.3), a support profile (10.4) is installed between the upper and lower horizontal profile (10.2, 10.3), spaced apart from the vertical profile (10.1) toward the front, and the inner cover (12.1) is attached to the front side or between the support profiles (10.4) of the two side frames (10) and the thermally insulating outer casing (12.3) is mounted to the front side, the rear side, or the between the vertical profiles (10.1).

10. The cooling unit system according to claim 9, wherein the evaporator (50, 50', 50") extending across the width of several cooling units (1, 2, 3) extends through between the vertical profiles (10.1) and the support profiles (10.4).

11. The cooling unit system according to claim 10, wherein between the inner cover (12.1) and the outer casing (12.3) of each shelving module (1, 2, 3), at least one fan (56) is provided and produces a cold air flow through the evaporator (50, 50', 50").

12. The cooling unit system according to claim 11, wherein one or more fans (56) situated laterally next to one another each is situated above the evaporator (50, 50', 50").

13. The cooling unit system according to claim 12, wherein the base group (11), on its upper side oriented toward the cooling chamber (4), has a floor cover (11.1) and, spaced apart from and below this, with a deflector plate (11.2) in order to form a lower horizontal intermediate space, the upper group (13), on its lower side oriented toward the cooling chamber (4), has a lower cover (13.1) and, spaced apart from and above this, with an upper cover (13.3) and/or an intermediate cover (13.2) in order to form an upper horizontal intermediate space, and the lower and upper horizontal intermediate spaces are fluidically connected to the vertical intermediate space which contains the evaporator (50, 50', 50") and is situated between the inner cover (12.1) and the outer casing (12.3) in the rear wall group (12) for a circulating cold air flow, with the circulation being completed via the front side of the cooling unit system.

14. The cooling unit system according to claim 13, wherein in the base group (11) on the underside of the deflector plate (11.2), an outer, lower flow conduit is either formed by a floor plate (11.3) situated below the deflector plate or is embodied inside the deflector plate (11.2), in the upper group (13) between the upper cover (13.3) and the intermediate cover (13.2), an outer, upper flow conduit is formed, in the rear wall group (12) between the front side of the outer casing (12.3) and the intermediate partition, an outer, vertical flow conduit is formed, and the outer, lower flow conduit and the outer, upper flow conduit are fluidically connected to the outer, vertical flow conduit to form a circulating warm air flow, with the circulation being completed via the front side of the cooling unit system.

15. The cooling unit system according to claim 1, wherein the cooling device is connected via connecting lines to a central heat exchanger (54).

16. The cooling unit system according to claim 1, wherein in the rear wall group (12) between a thermally insulating outer casing (12.3) and an inner cover (12.1) that adjoins the cooling chamber (4) at the back and has ventilation openings, a vertical intermediate space is provided, the vertical intermediate spaces of adjacent shelving modules (1, 2, 3) complement one another to form a combined intermediate space extending continuously across an entire width of the cooling unit system, the intermediate space is closed in a sealed fashion at the lateral ends, and the evaporator (50, 50', 50") extends in the combined intermediate space.

17. The cooling unit system according to claim 1, wherein a receiving device for each shelving module (1, 2, 3) or for only one of the shelving modules (1, 2, 3) and for the detachable installation of the cooling components of the cooling device 5 has in a lower region of the rear wall group (12) a receiving chamber for a compressor (51) and has in the rear wall group (12) or in or on the upper group (13) a receiving part for the control unit (55.1) and/or a condenser (52).

18. The cooling unit system according to claim 6, wherein in addition, only one condenser (52) is in the cooling unit system for the part of the group of shelving modules (1, 2, 3) or for all of the shelving modules (1, 2, 3) and is situated in the same shelving module (1, 2, 3) as the compressor (51) and the control unit.

19. The cooling unit system according to claim 4, wherein the side frames (10) each has a rear vertical profile (10.1), a lower horizontal profile protruding forward from it at the bottom, and an upper horizontal profile protruding forward from it at the top (10.2, 10.3), a support profile (10.4) is installed between the upper and lower horizontal profile (10.2, 10.3), spaced apart from the vertical profile (10.1) toward the front, and the inner cover (12.1) is attached to the front side or between the support profiles (10.4) of the two side frames (10) and the thermally insulating outer casing (12.3) is mounted to the front side, the rear side, or the between the vertical profiles (10.1).

20. The cooling unit system according to claim 4, wherein between the inner cover (12.1) and the outer casing (12.3) of each shelving module (1, 2, 3), at least one fan (56) is provided and produces a cold air flow through the evaporator (50, 50', 50").

21. The cooling unit system according to claim 4, wherein the base group (11), on its upper side oriented toward the cooling chamber (4), has a floor cover (11.1) and, spaced apart from and below this, with a deflector plate (11.2) in order to form a lower horizontal intermediate space, the upper group (13), on its lower side oriented toward the cooling chamber (4), has a lower cover (13.1) and, spaced apart from and above this, with an upper cover (13.3) and/or an intermediate cover (13.2) in order to form an upper horizontal intermediate space, and the lower and upper horizontal intermediate spaces are fluidically connected to the vertical intermediate space which contains the evaporator (50, 50', 50") and is situated between the inner cover (12.1) and the outer casing (12.3) in the rear wall group (12) for a circulating cold air flow, with the circulation being completed via the front side of the cooling unit system.

* * * * *